US008783671B2

(12) United States Patent
Ranieri et al.

(10) Patent No.: US 8,783,671 B2
(45) Date of Patent: Jul. 22, 2014

(54) CLAMP

(75) Inventors: Eric Ranieri, Besancon (FR); Stephen Rowlay, Sheffield (GB); Robert Christie, South Glastonbury, CT (US); Stephen Skeels, Glastonbury, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 677 days.

(21) Appl. No.: 13/044,332

(22) Filed: Mar. 9, 2011

(65) Prior Publication Data

US 2011/0221110 A1 Sep. 15, 2011

Related U.S. Application Data

(60) Provisional application No. 61/312,508, filed on Mar. 10, 2010.

(51) Int. Cl.

| | |
|---|---|
| ***B23P 19/04*** | (2006.01) |
| ***B25B 27/14*** | (2006.01) |
| ***B25B 1/00*** | (2006.01) |
| ***B25B 1/20*** | (2006.01) |
| ***B23Q 3/02*** | (2006.01) |
| ***B25B 1/02*** | (2006.01) |

(52) U.S. Cl.
USPC ..... 269/6; 269/3; 269/207; 269/45; 269/95; 29/276; 29/257

(58) Field of Classification Search
USPC ..... 269/3, 6, 45, 95, 143, 249, 166, 902; 29/276, 257
See application file for complete search history.

(56) References Cited

U.S. PATENT DOCUMENTS

| | | | | |
|---|---|---|---|---|
| 1,675,420 | A | 7/1928 | Parsons | |
| 2,112,873 | A * | 4/1938 | Wright | 81/343 |
| 2,472,658 | A | 6/1949 | Gilbert | |
| 2,638,805 | A * | 5/1953 | Bigelow | 269/3 |
| 6,564,703 | B1 | 5/2003 | Lin | |
| 6,893,012 | B2 | 5/2005 | Wong | |
| 6,966,550 | B2 | 11/2005 | Marks | |
| 7,004,459 | B2 | 2/2006 | Sato et al. | |
| 7,007,937 | B2 | 3/2006 | Foshag et al. | |
| 7,306,212 | B2 | 12/2007 | Cantin | |
| 2006/0208407 | A1 | 9/2006 | Wang | |
| 2009/0014934 | A1 | 1/2009 | Seber | |

FOREIGN PATENT DOCUMENTS

WO WO2008/113980 * 9/2008

OTHER PUBLICATIONS

WO/2008113980 by Simon Mills. Published Sep. 25, 2008.*

* cited by examiner

*Primary Examiner* — Lee D Wilson
*Assistant Examiner* — Nirvana Deonauth
(74) *Attorney, Agent, or Firm* — Pillsbury Winthrop Shaw Pittman LLP

(57) ABSTRACT

A clamp includes a first jaw, a second jaw, a first connection, a second connection, and an actuator. The first jaw and the second jaw include a first clamp surface and a second clamp surface, respectively. The first connection operatively connects the first jaw to the second jaw in a manner that permits relative movement between the first jaw and the second jaw. The second connection is operatively connected between the first jaw and the second jaw. The actuator is configured to shorten a length of the second connection to thereby reduce a relative distance between the first clamp surface and the second clamp surface.

32 Claims, 22 Drawing Sheets

CLAMP

CROSS-REFERENCE TO RELATED APPLICATIONS

This application claims the benefit of priority from U.S. Provisional Patent Application No. 61/312,508, filed Mar. 10, 2010, the content of which is incorporated herein by reference in its entirety.

BACKGROUND OF THE INVENTION

Field of the Invention

The present invention relates to a clamp.

A clamp is used by positioning jaws of the clamp on surfaces a workpiece to be clamped. The workpiece is any member or members that needs clamping. For example, the workpiece may be two elements that are being joined together by adhesive or otherwise and require a clamping force to facilitate a strong connection.

The present invention provides improvements over the prior art clamps.

SUMMARY

One aspect of the invention relates to a clamp that includes a first jaw, a second jaw, a first connection, a second connection, and an actuator. The first jaw and the second jaw include a first clamp surface and a second clamp surface, respectively. The first connection operatively connects the first jaw to the second jaw in a manner that permits relative movement between the first jaw and the second jaw. The second connection is operatively connected between the first jaw and the second jaw. The second connection includes a flexible member. The actuator is operably connected with the flexible member. The actuator is configured to shorten a length of the second connection to thereby reduce a relative distance between the first clamp surface and the second clamp surface.

Another aspect of the invention relates to a clamp that includes a first jaw, a second jaw, a flexible member, a spool and a lever. The first jaw includes a first clamp surface and the second jaw includes a second clamp surface. The first jaw is arranged for pivotal movement relative to the second jaw. The flexible member extends between the first jaw and the second jaw. The spool is rotatable to take up the flexible member to reduce a distance between the first and the second clamp surfaces. The lever is operable to rotate the spool.

Yet another aspect of the invention relates to a clamp that includes a first jaw, a second jaw, a first connection, a second connection, and an actuator. The first jaw and the second jaw include a first clamp surface and a second clamp surface, respectively. The first connection operatively connects the first jaw to the second jaw in a manner that permits relative movement between the first jaw and the second jaw. The second connection is operatively connected between the first jaw and the second jaw. The actuator is operably connected with the second connection. The actuator is configured to shorten a length of the second connection to thereby reduce a relative distance between the first clamp surface and the second clamp surface.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein can be considered drawn to scale. It is to be expressly understood, however, that the drawings are for the purpose of illustration and description only and are not intended as a definition of the limits of the invention. It shall also be appreciated that the features of one embodiment disclosed herein can be used in other embodiments disclosed herein. As used in the specification and in the claims, the singular form of "a", "an", and "the" include plural referents unless the context clearly dictates otherwise.

BRIEF DESCRIPTION OF THE DRAWINGS

FIG. 5 is a side view of the clamp, wherein jaws of the clamp are manually separated by the user in accordance with an embodiment of the present invention;

FIG. 6 is a side view of the clamp, wherein a releasable lock button is manually released so that the releasable lock is locked to retain the jaws in the desired position in accordance with an embodiment of the present invention;

FIG. 7 is a side view of the clamp, wherein a quick close operation is initiated to at least initially, quickly lessen the distance between clamp surfaces and the surfaces of the workpiece to be engaged in accordance with an embodiment of the present invention;

FIG. 8 is a side view of the clamp in the quick close operation in accordance with an embodiment of the present invention;

FIG. 9 is a side view of the clamp, wherein a clamping force may be applied to the workpiece by squeezing of lever in accordance with an embodiment of the present invention;

FIG. 10 is a side view of the clamp, wherein the lever has been moved towards the hand grip portion, and the spool has been wound to take up addition portions of the flexible member to apply a clamping force on the workpiece in accordance with an embodiment of the present invention;

DETAILED DESCRIPTION OF THE INVENTION

Figure 1:
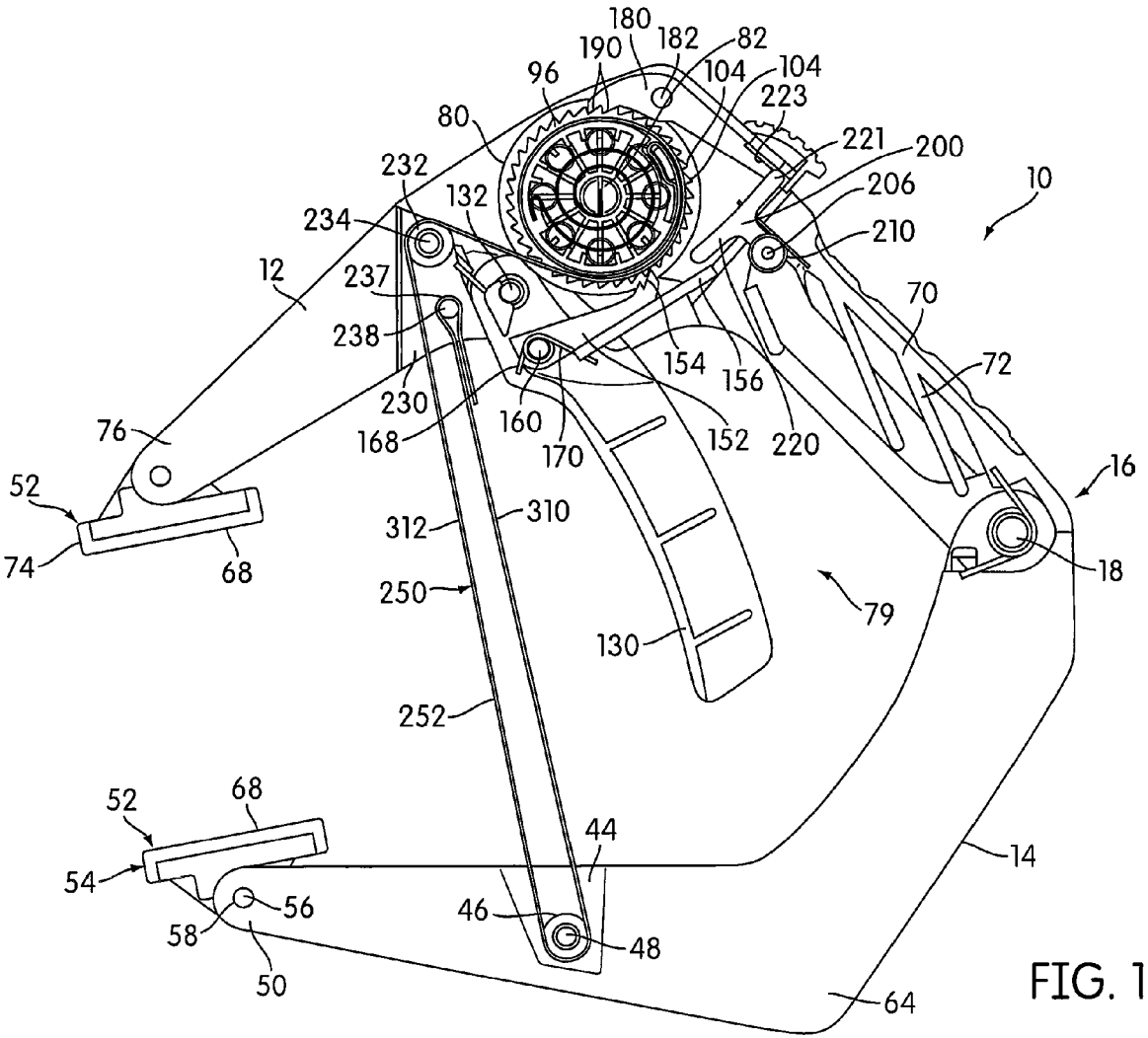
FIG. 1 shows a side view of a clamp, with certain portions removed to better reveal others, in accordance with an embodiment of the present invention.
Figure 2:
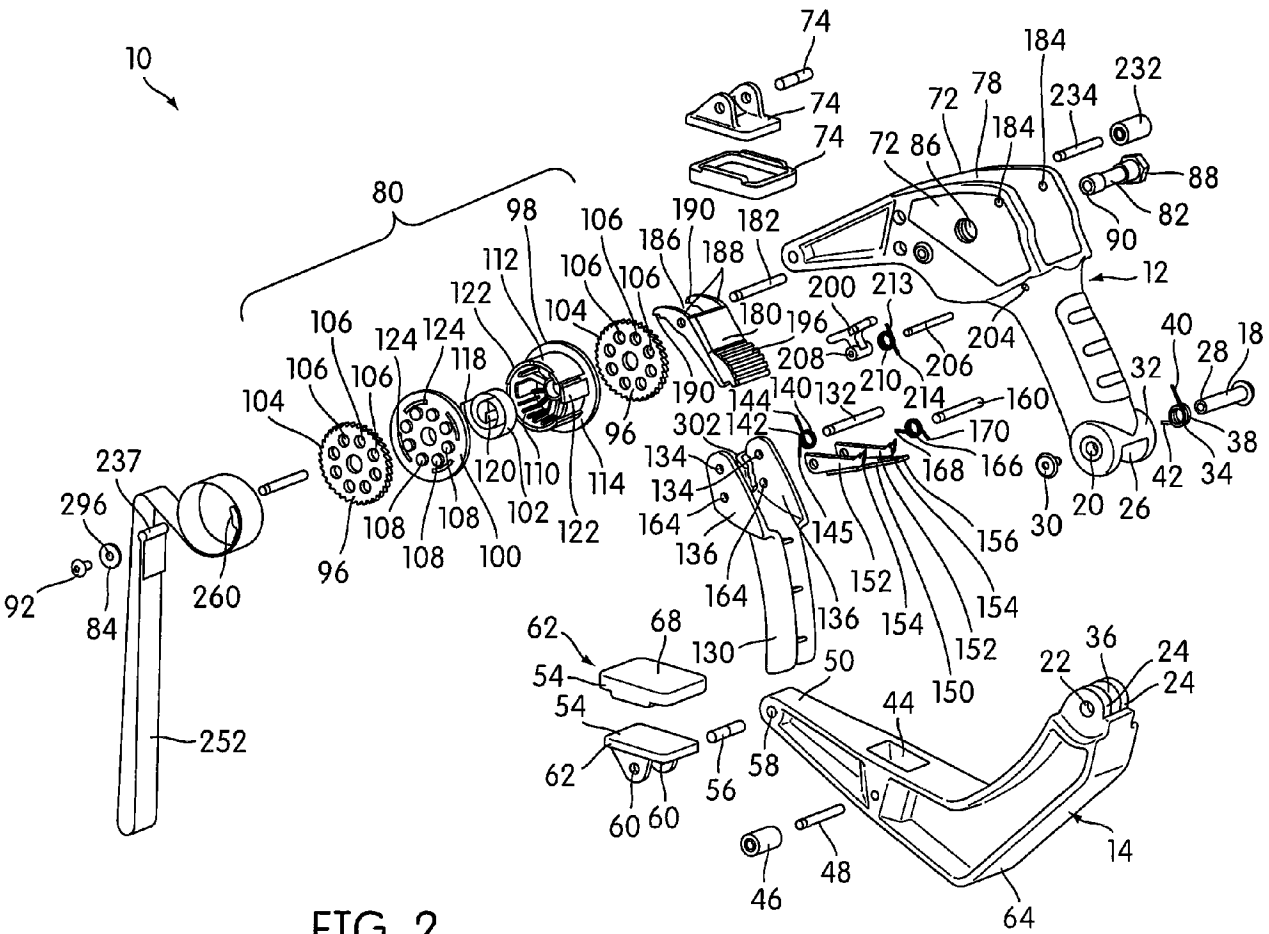
FIG. 2 shows an exploded view of the clamp in accordance with an embodiment of the present invention.

A clamp 10 in accordance with one embodiment of the invention is shown in FIGS. 1 and 2. FIG. 1 is a side view of the clamp 10, with certain portions of the jaws removed to better show other internal components for purposes of explanation. FIG. 2 is an exploded view of this same embodiment. As shown in these figures, the clamp 10 includes a first jaw 12 and a second jaw 14. A first connection 16 operatively connects the first jaw 12 to the second jaw 14 in the manner that permits relative movement (such as pivotal movement, for example) between the first jaw 12 and the second jaw 14. In the embodiment shown, each jaw 12 and 14 has a generally curved or arcuate configuration, and the first connection 16 is provided by a pivot bolt 18 that extends between aligned openings 20 and 22 (as shown in FIG. 2) in the first jaw 12 and the second jaw 14, respectively. As shown, the openings 22 in the second jaw 14 are provided in spaced connecting portions 24 in a proximal portion of the second jaw 14. The connecting portions 24 are on opposite sides of a recess or gap 36 therebetween. A distal end 28 of the pivot bolt 18 has an internal threaded region that is engaged by a threaded fastener 30 so as to secure the connecting portions 24 of the second jaw 14 to a connecting region 32 of the first jaw 12 to enable pivotal movement between the first jaw 12 and the second jaw 14 about the pivot bolt 18. In one embodiment, a pivot spring 34 is disposed within the gap 36 between connecting portions 24 of the second jaw 14. The pivot spring 34 has coils 38 thereof disposed around the pivot bolt 18, and has a first tang 40 operatively connected with the first jaw 12 and a second tang 42 operatively connected with the second jaw 14. The pivot spring 34 is constructed and arranged to bias the first jaw 12 and the second jaw 14 away from one another in the pivotal action about the pivot bolt 18.

The second jaw 14 includes a cavity 44 in which is disposed a pulley 46 which is rotatable about a pulley pin 48. The pulley pin 48 is connected on opposite sides thereof to the second jaw 14. Disposed towards a distal end portion 50 of the second jaw 14 is a clamp member 52. The clamp member 52, in one embodiment, is a pivoted structure 54 that is pivotally mounted to the distal end portion 50 by a pivot pin 56 that is disposed within an opening 58 in the distal end portion 50 and also extends through aligned openings 60 in the pivoted structure 54 as shown in FIG. 2. In one embodiment, the pivoted structure 54 includes a base member 62, which may be, for example, made of a relatively rigid material, such as a metal or a hard plastic. The pivoted structure 54 may also include a base cover 62 that includes a clamp surface 68, which may be formed of a different material than the base member 62, such as an elastomeric or a resilient material. In the illustrated embodiment, the pivoted structure 54 may be considered to form part of the second jaw 14, although in the illustrated embodiment it is movable relative to a main body 64 of the second jaw 14. The pivoted structure 54 is capable of limited relative pivotal movement relative to the main body 64 of the second jaw 14 to accommodate workpieces of slightly different sizes and shapes to be clamped.

It should be appreciated that in alternative embodiments, the clamp surface 68 may be provided directly on the main body 64 of the second jaw 14, with no relative pivotal movement of the clamp surface 68 relative to the main body 64. In other words, the clamp member 52 may have no pivoted structure, but instead form a part or surface on the main body 64.

The first jaw 10 includes a main body 70 of an arcuate configuration generally similar to that of the main body 64, but in an opposing relationship. The main body 70 includes a handgrip portion 72 and a clamp member 52 or pivoted structure 74 at the distal end 76 of the main body 70. The pivoted structure 74 is substantially the same as the pivoted structure 54, as would be appreciated by one of ordinary skill in the art reading this specification.

The clamp 10 has an actuator 79 that is operatively connected with a flexible member 252 (as will be described later). The actuator 79 is configured to shorten a length of a second connection 250 that comprises the flexible member 252, to thereby reduce a distance between the clamp surfaces 68. The actuator 79 may take several different forms. In the illustrated embodiment, the actuator 79 includes a spool 80 operatively connected to a lever 130.

The main body 70 has, among other things, a pair spaced outer walls 72 defining therebetween a recess 78, as shown. The spool 80 is received with the recess 78 and is mounted for rotation about a spool axle 82. The spool axle 82 is aligned with a pair of aligned openings 86 in each of the outer walls 72. The spool axle 82 has an enlarged head 88 that prevents the head from going into the recess 78, and the size and shape of the head 88 serves to retain the head 88 in the opening 86 on the right side outer wall 72. The opposite end 90 of the spool axle 82 has an threaded opening therein for receiving a threaded axle bolt 92, which has a narrow threaded portion thereof passing through an opening 296 in washer 84 as it extends through opening 86 in the left outer wall 72 until it is received in the opening 90 in the spool axle 82.

The spool 80 includes a pair of spaced gear wheels 96, a spool cup 98, spool cover 100, and an actuator spring 102. In one embodiment, the actuator spring 102 may take the form of a spiral spring, although many different spring types can be used as will be appreciated by those skilled in the art reading this specification. In one embodiment, the actuator spring 102 may be omitted.

Each of the gear wheels 96, the spool cover 100, and the spool cup 98 has a central opening for receiving the spool axle 82 to facilitate rotation of the spool 80 about the spool axle 82. The gear wheels 96 each have a plurality of circumferentially spaced gear teeth 104. The gear wheels 96 also have a plurality of circumferentially spaced holes 106 disposed between the gear teeth 104 and the central opening. As illustrated in FIG. 2, the left side gear wheel 96 is rotationally coupled to the spool cover 100 as a result a plurality of circumferentially spaced projections 108 that are received in the plurality of circumferentially spaced holes 106. Similarly, although not shown, the right side of the spool cup 98 has a plurality circumferentially spaced projections 108 that are received in the circumferentially spaced openings 106 in the right side gear wheel 96. Thus, the right side gear wheel 96 is rotationally coupled with the spool cup 98. In another embodiment, instead of gear wheels with gear teeth, the spool may include driven structures or wheels that are constructed and arranged to engage with drive pawl and/or the locking pawl by a friction contact arrangement or a forced contact arrangement, as would be appreciated by one skilled in the art reading this specification. In such embodiments, drive pawl, other drive structure, and/or locking pawl or other lock member may include a friction contact arrangement or any other similar contact arrangement that is constructed and arranged to engage with the driven structures.

The spiral spring 102 is received within a recess 110 defined by a generally cylindrical, axially extending wall 112 of the spool cup 98. The cylindrical wall 112 of the spool cup 98 is integrally formed with a circular wall member 114 that forms the end of the spool cup 98. The spiral spring 102 has an outer tang 118 that is connected to the cylindrical wall 112, and an inner tang 120 that is received within a slot in the spool axle 82. As a result, the spiral spring 102 operates in a manner that biases the spool cup 98 in a rotational direction about the spool axle 82 (with the spool axle 82 remaining stationary relative to the outer walls 72 of the first jaw 12 by virtue of the interengagement of the flat sided head 88 of the spool axle 82 with the associated opening 86 in the right side of the outer wall 72) in a winding direction that is counter clock wise as viewed in FIG. 1.

The spool cover 100 closes off the recess 110 and is connected to the cylindrical wall 112 via four circumferentially spaced arcuate, projections 122 formed on the end of cylindrical wall 114 and that are received with aligned circumferentially spaced arcuate slots 124 in the spool cover 100.

As noted above, the spool 80 forms one part of what comprises the actuator 79 of one embodiment. Another component of the actuator 79 comprises the aforementioned lever 130 that can be actuated to rotate the spool 80. The lever 130 is pivotally mounted to the main body 70 of the first jaw 12 via a lever pivot pin 132. The lever pivot pin 132 passes through a pair of spaced openings 134 in side walls 136 of the lever 130. A lever spring 140 has coils 142 thereof disposed in surrounding relation to the lever pivot pin 132. In addition, a first tang 144 of the lever spring 140 is secured to a portion of the jaw 12, while on opposite tang 146 are secured to a portion of the lever 130. As a result, the lever spring 140 operates to bias the lever 130 in a direction away from the handgrip portion 72 of the first jaw 12. Positioned between the side walls 136 of the lever 130 is a drive structure 150. The drive structure 150 may, in one embodiment, be considered to be part of the actuator 79.

In one embodiment, the drive structure 150 may take the form of a drive pawl 150. The drive pawl 150 includes a pair of spaced drive members 152 each having drive teeth 154 at distal ends thereof. The drive teeth 154 are constructed and arranged to engage with the gear teeth 104 as will be explained later. Extending between the drive members 152 is a release surface 156 as will also be described later. The drive pawl 150 is pivotally connected to the side walls 136 by a drive pawl pin 160. The drive pawl pin 160 is connected at spaced holes 164 in the sidewall 136. The drive pawl 150 pivots about the drive pawl pin 160, and a drive pawl spring 166 has the coils thereof dispose and surrounding relation to the drive pawl pin 160. A first tang 168 of the drive pawl spring 166 is secured to the lever 130, and a second tang 170 of the drive pawl spring 166 is connected to the drive pawl 150. The drive pawl spring 166 is arranged to bias the drive pawl 150 in a pivotal direction such that the drive teeth 154 thereof are biased towards the gear teeth 104.

A releasable lock 180 is pivotally mounted between the outer walls 72 of the first jaw 12. Specifically, a lock pin 182 is connected at opposite recesses 184 in the outer walls 172 and extends through openings 186 formed in side walls 188 of the releasable lock 180. Thus, the releasable lock 180 pivots about the lock pin 182. The distal ends of the side wall 188 are formed with lock teeth 190 that are adapted to engage with the gear wheel teeth 104 as will be described later. The releasable lock 180 includes a manually engageable portion 196.

A bell crank member 200 is pivotally mounted to the first jaw 12 at lower portions of the outer walls 72. Specifically, a pair of recesses or openings 204 are provided in the lower portions of the outer walls 72 and adapted to receive a bell crank pin 206. The bell crank pin 206 is received within an opening 208 in the bell crank member 200 so that the bell crank member 200 is constructed and arranged to pivot about the bell crank pin 206. A bell crank spring 210 has a first tang 212 operatively connected to the belt crank member 200 and in opposite tang 214 operatively connected to the main body 70 of the first jaw 12. As a result, the bell crank member 200 is capable of pivoting relative to the main body 70 about the bell crank pin 206. The bell crank spring 210 biases the bell crank member 200 to pivot in a clockwise direction as seen in FIG. 1, so that an engagement portion 220 is biased away from the release surface 156 of the drive pawl 150. In one embodiment, the bell crank member 200 is optional and may serve to prevent the clamp lockup when the lever 130 is squeezed.

Disposed within the first jaw 12 at an intermediate portion thereof is a downwardly facing recess 230 as seen in FIG. 1. This recess 230 is similar to the recess 44 in the second jaw 14, and carries therein a top pulley 232. The top pulley 232 is mounted for rotation about a pulley pin 234, with the pulley pin 234 secured at opposite ends thereof to opposite walls defining opposite sides of the recess 230. Also disposed within the recess 230 is an anchor portion 238.

A second connection 250 is provided between the first jaw 12 and the second jaw 14. In this embodiment, the second connection 250 includes a flexible member 252 that is connected at one end 237 to the anchor portion 238 on the first jaw 12, and is wrapped around the lower pulley 46 on the second jaw 14 so as to provide the operative second connection between the two jaws 12 and 14. The flexible member 252, after being wrapped around the lower pulley 46, extends back to the first jaw 12 to be wrapped around the top pulley 232 and then extends to the spool 80 and wound about the outer surface of the cylindrical wall 112 of the spool 80. An end 260 of the flexible member 252 is fixed to the spool cup 98, for example, by being received within a slot in a cylindrical wall 112 and secured to a structure within the recess 110.

In one embodiment, as illustrated, the second connection 250 is spaced from the first connection 16. For example, in a non-limiting embodiment, the second connection 250 (e.g., flexible member 252) is closer to one or both of the clamp surfaces 68 than the pivot axis defined by the pivot bolt 18. In another embodiment, however, the second connection 250 may be closer to the first connection 16 than the clamp surfaces 68.

Operation of the clamp 10 will now be described.

Figure 3:
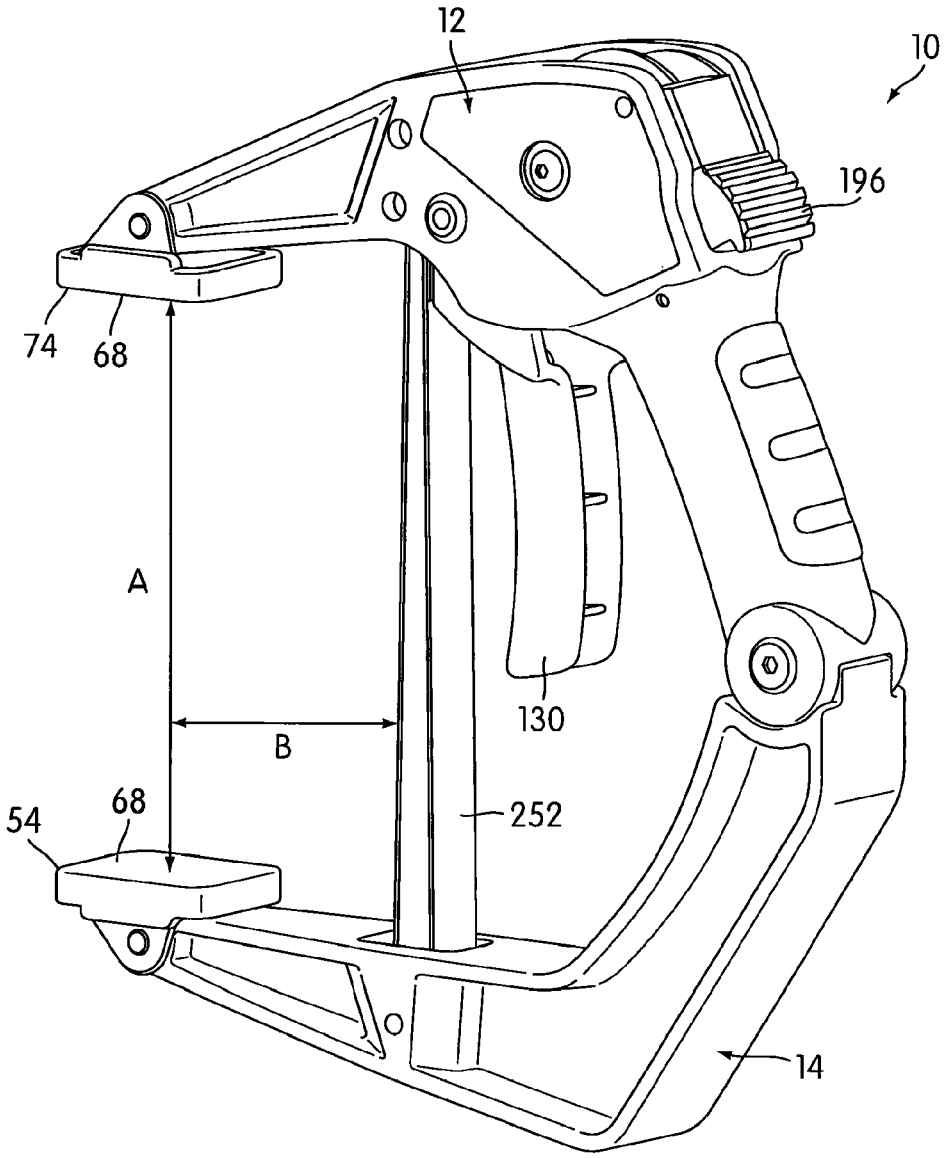
FIG. 3 shows an isometric view of the clamp in a fully open position in accordance with an embodiment of the present invention.

FIG. 3 is an isometric view of the clamp 10 in a fully open position. In one embodiment, in the full open position, the distance between the clamp surface 68 of the pivoted structure 54 and the clamp surface 68 of the upper pivot structure 74 can be 6 inches or greater (illustrated by the distance A in FIG. 3). In addition, in one embodiment the distance between the forward portion of the flexible member 252 and an imaginary line extending between the central point of the two clamp surfaces 68 (indicated by distance B in FIG. 3) is 3 inches or greater, although smaller distances are contemplated.

In the view illustrated in FIG. 1, the teeth 154 on drive members 152 are shown in engagement with the teeth 104 on the associated gear wheels 96. Similarly, the lock teeth 190 of the releasable lock 180 are shown in engagement with the teeth 104 of the gear wheels 96. In this view of FIG. 1, the clamp 10 is being ratcheted by drive pawl 150 and locked against reversed movement by the releasable lock 180. In this configuration, the drive members 152 have been used in conjunction with the lever 130 to rotate the gear wheel 96 and hence the spool 80 in a counter clockwise direction to shorten the length of the second connection 250 until the clamp surfaces 68 are firmly in engagement with a workpiece (although no workpiece is shown in FIG. 1). In addition, the lock teeth 190 of the releasable lock 180 are engagement with gear teeth 104 to prevent clockwise rotation of the gear wheel 96 and hence the unwinding of the spool 80 when a workpiece is gripped. During the levering action that drives the gear wheels 96 in a counter clockwise direction, the lock teeth 190 of the releasable lock 180 ride over the teeth 104 of the gear wheels 96 and make a (clicking) sound as the spool 80 is rotating in a counterclockwise direction to wind up the flexible member 252. The lock teeth 190 of the releasable lock 180 is maintained in such ratcheting engagement with the gear teeth 104 as the result of being biased pivotally into the engaged position by a contact portion 221 of the bell crank member 200, which is biased by bell crank spring 210 in a clockwise direction. The contact portion 221 of bell crank member 200 hence contacts an undersurface 223 to rotate or bias the releasable lock 180 in a counterclockwise pivotal direction about the lock pin 182.

Figure 4:
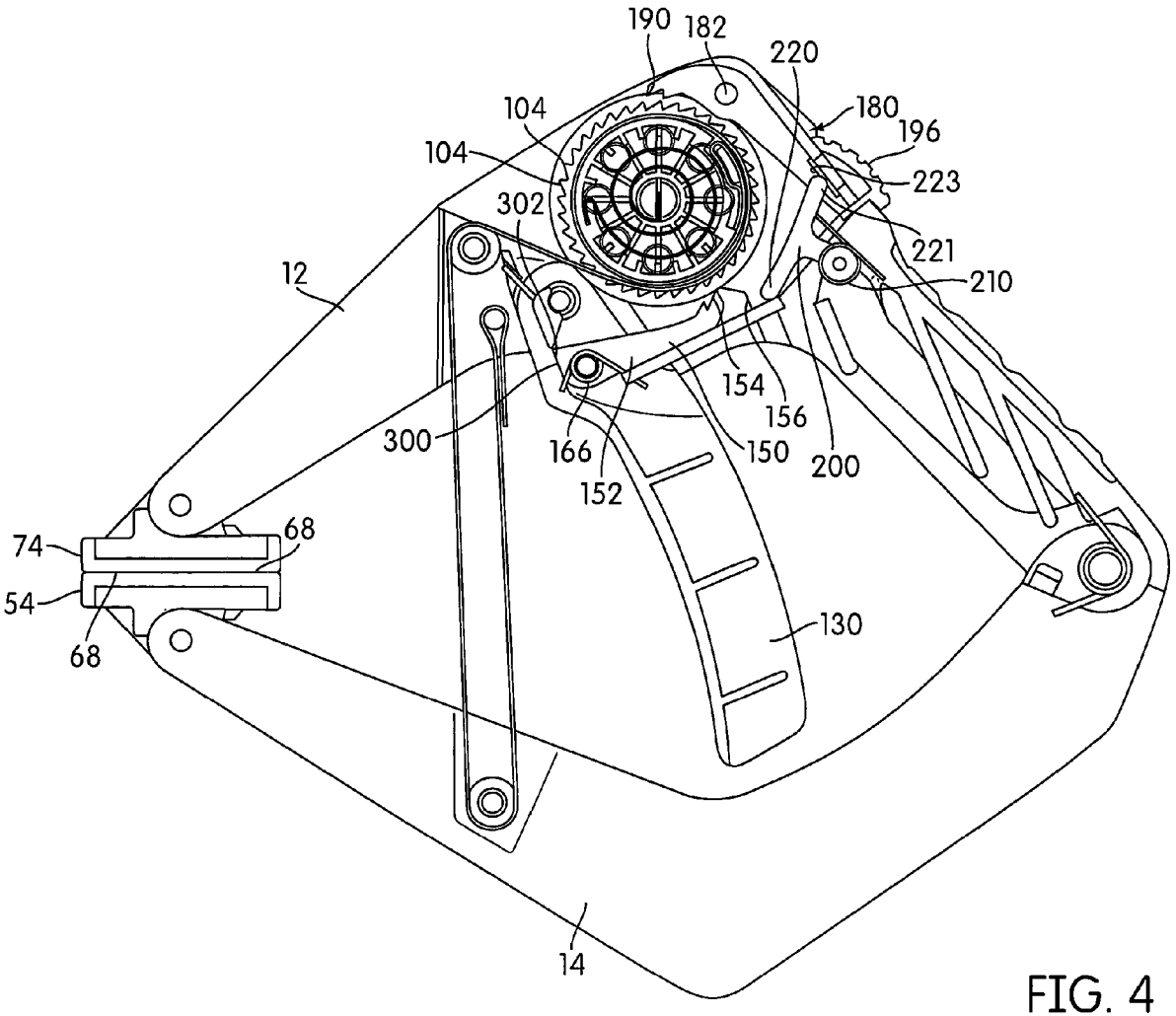
FIGS. 4-10 are side views of the clamp in which various portions thereof (such as one side wall portion of each jaw) have been removed to better reveal others; wherein FIG. 4 in particular shows a side view of the clamp, wherein jaws of the clamp are in a closed configuration in accordance with an embodiment of the present invention.

Typically, after use of the clamp 10, the two jaws 12, 14 are brought together to provide a compact configuration for storage purposes. When the clamp 10 is stored, although the releasable lock 180 may assume the position shown in FIG. 1, the drive pawl 150 will be out of engagement with the gear teeth 104 as illustrated in the configuration of FIG. 4.

When the clamp 10 is to be used, the operator first separates the jaws 12 and 14 to enable a workpiece to be disposed between the clamp surfaces 68. To enable the opening of the jaws 12 and 14, the manual engageable portion 196 of the releasable lock 180 is depressed by the user, as illustrated in FIG. 4. As a result of this action, the releasable lock 180 has been pivoted in a clockwise direction about the lock pin 182 so that the lock teeth 190 are brought out of engagement with the gear teeth 104, as shown in FIG. 4. In addition, by depressing the manually engageable portion 196, the undersurface 223 of the releasable lock 180 engages with the contact portion 221 of the bell crank member 200 so as to rotate the bell crank member 200 in a counterclockwise direction, against the bias of the bell crank spring 210 to move it into the position shown in FIG. 4. In addition, as shown in FIG. 4, when the jaws 12 and 14 are in the closed configuration, the drive pawl 150 is held out of engagement with the gear teeth 104 as a result of a back-end stop surface 300 on the drive members 152 that engage with an inner stop surface 302 of an inner portion of the lever 130. The engagement of the stop surface 300 of the drive members 152 against the stop surface 302 inside the lever 130 pushes the drive pawl 150 in a clockwise direction against the bias of the drive pawl spring 166 when the clamp 10 is in a closed configuration as shown in FIG. 4.

Figure 13:
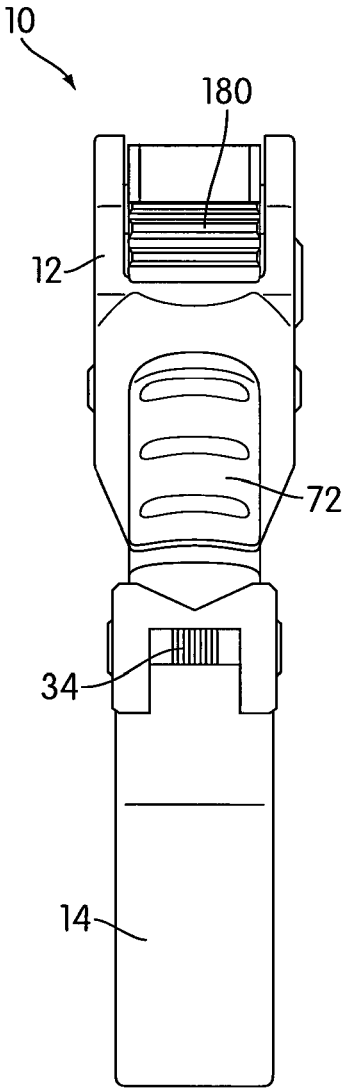
FIG. 13 shows a rear elevational view of the clamp in accordance with an embodiment of the present invention.
Figure 13A:
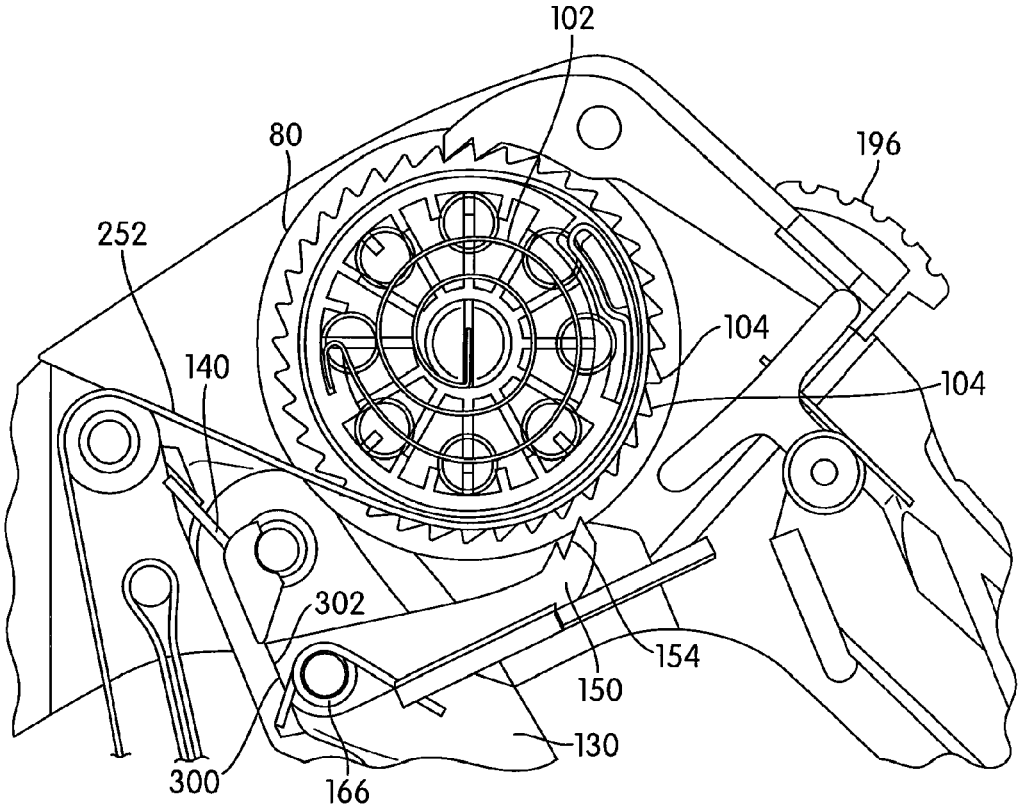
FIGS. 13A-C show engagement and disengagement of stop surface of a drive pawl against stop surface in accordance with an embodiment of the present invention.
Figure 13B:
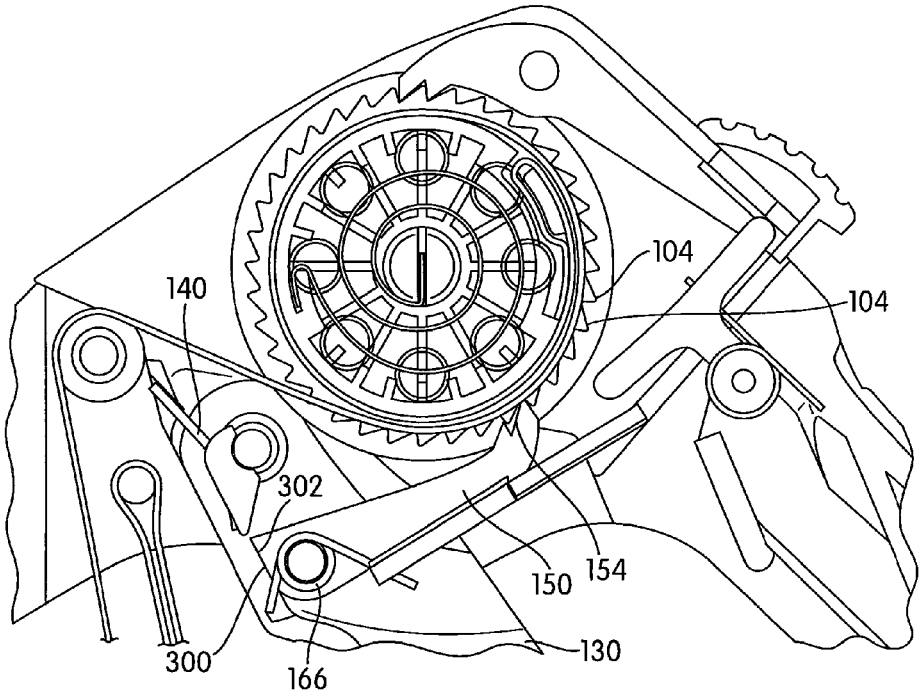
Figure 13C:
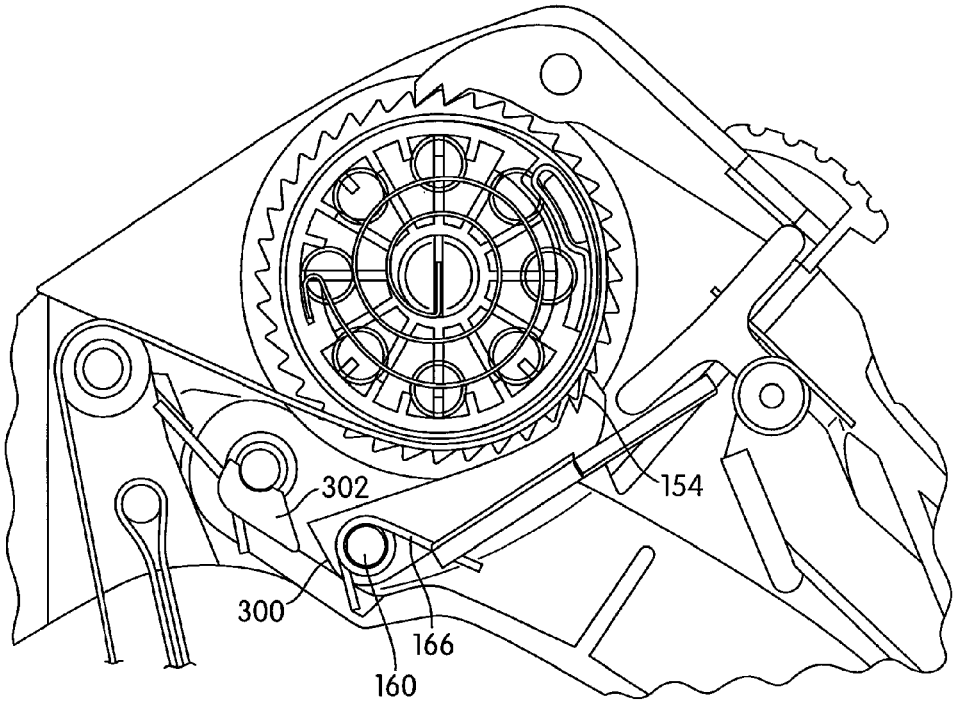

FIGS. 13A-C show engagement of the stop surface 300 of drive members 152 against the stop surface 302 inside the lever 130 in accordance with an embodiment of the present invention. As shown in FIG. 13A, when the lever 130 is in home position (i.e., not manually squeezed), the drive pawl teeth 154 are not engaged between the gear teeth 104, so that when the manually engageable portion 196 is pushed, the spool 80, under the force of the spring 102, can reel in the strap 252 and close the clamp 10 automatically. In FIG. 13A, the drive pawl 150 is biased by the drive pawl spring 166 in a counterclockwise direction so that the stop surface 300 of the pawl 150 is brought to rest against the stop surface 302 of the lever 130. In an alternative embodiment (not shown), the drive pawl 150 can remain engaged with gear teeth 104, and the spool 80 (driven by the spiral spring 102) would have to overcome the friction created by the drive pawl teeth 154 sliding over the gear wheel teeth 104 as the spool 80 turns counterclockwise under the force of the spring 102.

When the lever 130 is initially squeezed in a clamping action, the lever 130 is pivotally moved until the drive pawl teeth 154 are moved (along with the lever 130) into engagement with gear wheel teeth 104 as shown in FIG. 13B. During this initial lever movement, the stop surface 300 of the pawl 150 is held in contact with the surface 302 of the lever 130 by the drive pawl spring 166. However, as shown in FIG. 13C, continued movement (e.g., by squeezing) of the lever 130 will cause the drive pawl teeth 154 to ride along with the gear teeth 104, so that the pawl 150 pivots clockwise relative to the pin 160. As a result, the stop surface 300 of the pawl 150 moves away from the stop surface 302, against the bias of the spring 166.

As shown in FIG. 13C, the lever 130 has been fully squeezed, and the drive pawl 150 remains engaged with gear teeth 104. During this movement, the stop surface 300 of the drive pawl 150 has moved away from the stop surface 302.

Figure 5:
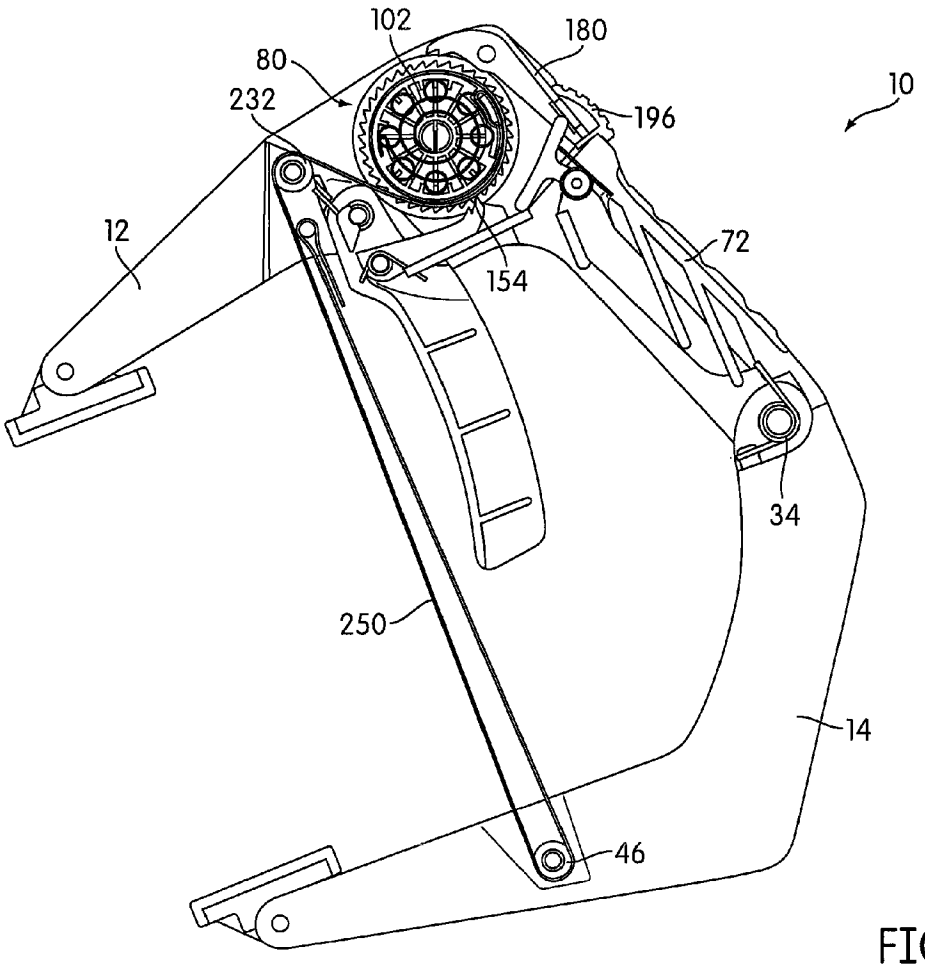

FIG. 5 illustrates a condition of the clamp 10 in which the jaw members 12, 14 have been manually separated. Specifically, with the releasable lock 180 held in the released condition by user's thumb, for example with the user grasping the clamp 10 at hand grip portion 72, the user may then take his opposite hand and pull downwardly on the second jaw 14 so as to separate the jaw members (as shown in FIG. 5). During this operation, the jaws 12 and 14 are moved (separated) against the bias of the pivot spring 34, and the flexible member 252 is pulled so as to be un-wound about the spool 80, which is rotated in a clockwise direction against the bias of the spiral spring 102 under the manual force of jaw separation. During this action, the lower pulley 46 is rotated in a counterclockwise direction, and the upper pulley 232 is also rotated in a counterclockwise direction to accommodate elongation of the second connection 250.

Figure 6:
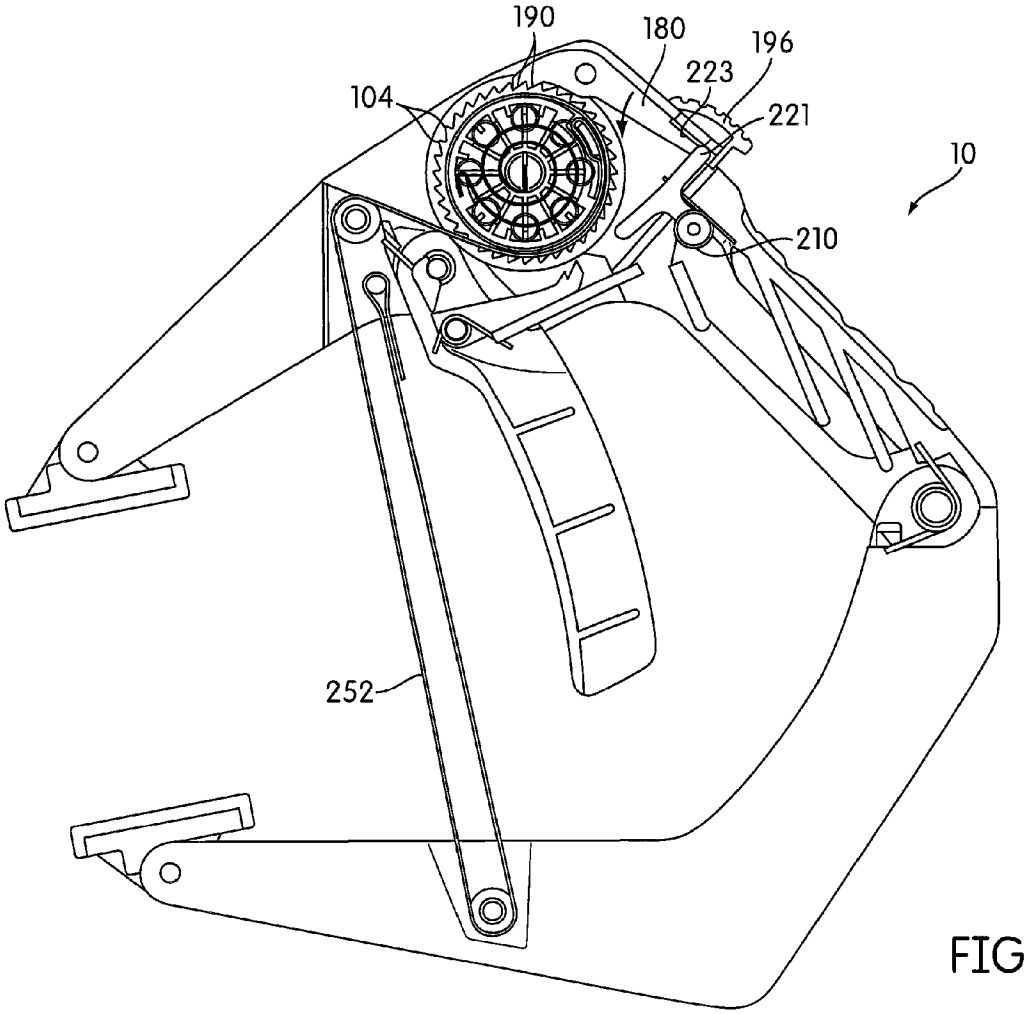

When the jaws 12 and 14 are moved to a sufficiently separated condition (e.g., to accommodate a certain workpiece), the manually engageable portion 196 of the releasable lock 180 is disengaged or released by the user. As a result, as shown in FIG. 6, the bias of the bell crank spring 210 rotates the bell crank member 200 in a clockwise direction so that the contact portion 221 engages the undersurface 223 of the releasable lock 180 so that the teeth 190 of the releasable lock 180 are pivoted into engagement with the gear teeth 104. Thus, the action of the releasable lock 180 retains the spool 80 in the desired position and prevents further opening of the jaws 12 and 14. In this configuration, the pivot spring 34 operates to force the top and bottom jaws 12, 14 apart to take up any slack in the flexible member 252. In the configuration shown in FIG. 6, the clamp 10 is now ready to be closed onto a workpiece.

Figure 7:
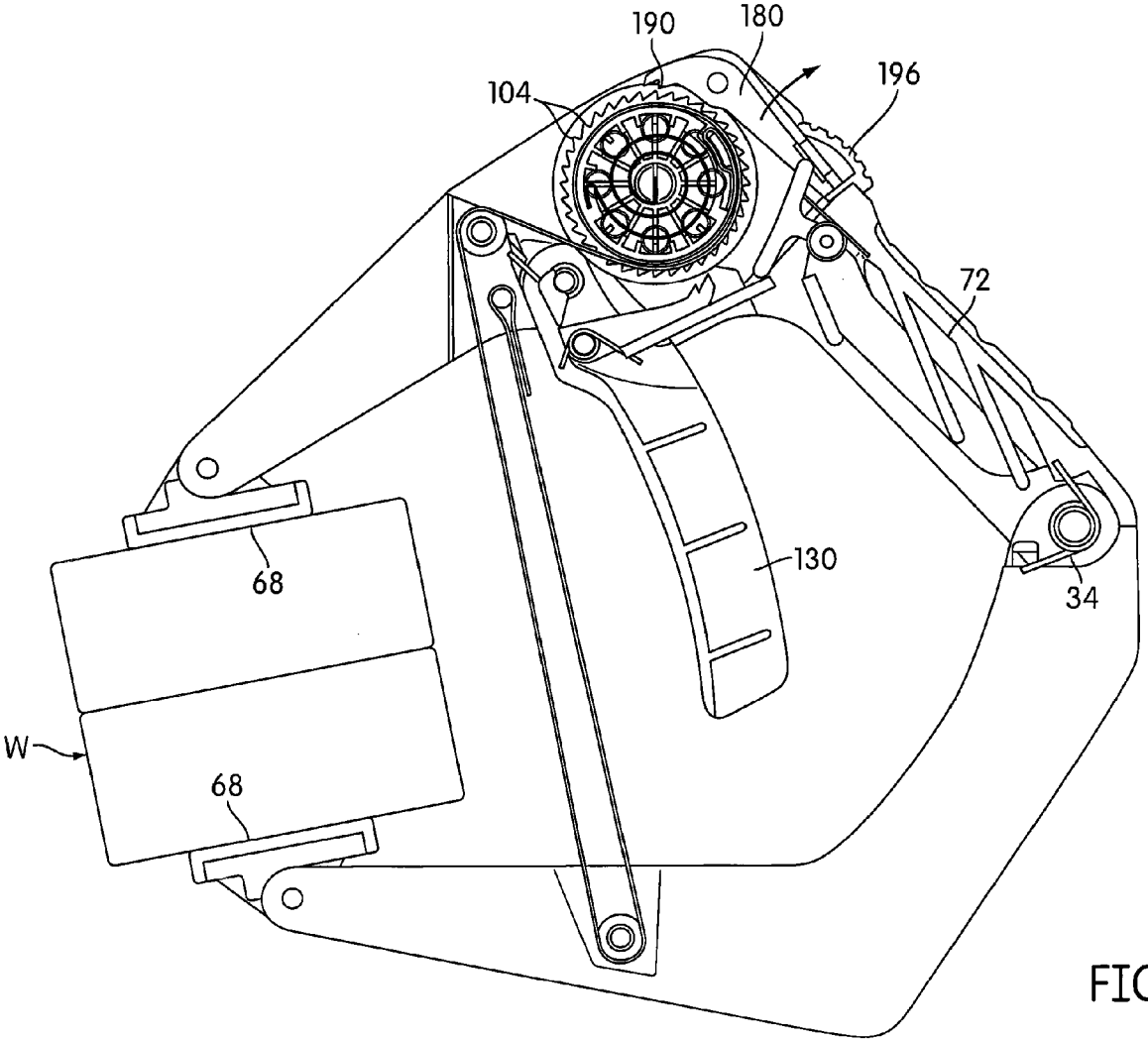
Figure 8:
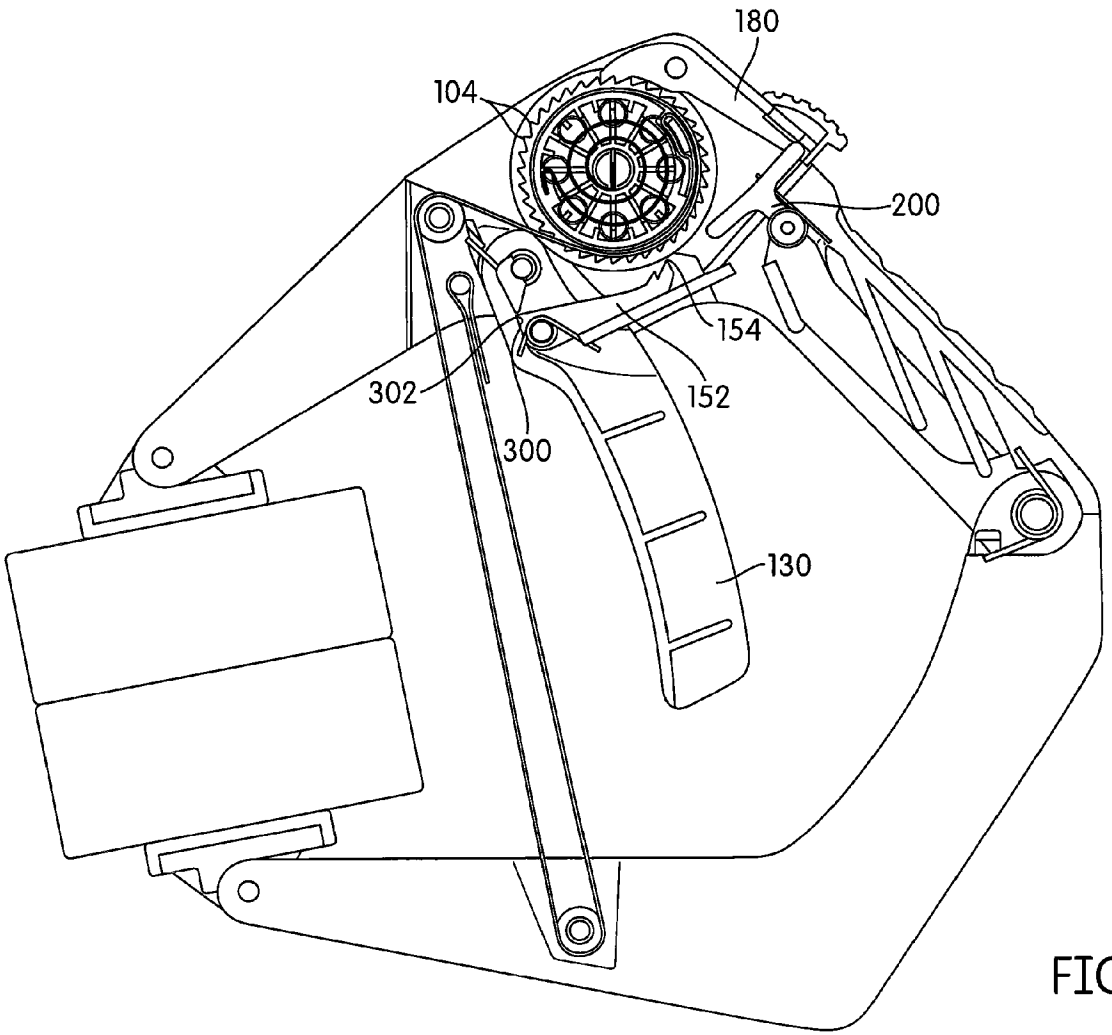

To affect closing of the clamp 10 onto a workpiece, the user has the option of slowly closing the clamp 10 by a ratcheting action effected by moving the lever 130 in a back and forth motion towards the hand grip 72, or by initially effecting (a quick close) operation to at least initially, quickly lessen the distance between the clamp surfaces 68 and the surfaces of the workpiece to be engaged. To effect a quick close operation, shown in FIG. 7, the releasable lock 180 is released by depressing the manually engageable portion 196 so that the teeth 190 are disengaged from the gear teeth 104. As a result of this action, the spiral spring 102 inside the spool 180 begins to wind up the flexible member 252. The spring force provided by the spiral spring 102 is greater than the spring force of the pivoted spring 34 so that the jaws are brought together to engage opposites sides of the workpiece, as illustrated in FIG. 7. This action quickly moves the clamp surfaces 68 into engagement with opposite sides of the workpiece W. Subsequently, the releasable lock 180 is disengaged by the user, so that the bell crank member 200 rotates clockwise to thereby engage the releasable lock 180 and move the locking teeth 190 thereof into engagement between the gear teeth 104, as illustrated in FIG. 8.

Figure 9:
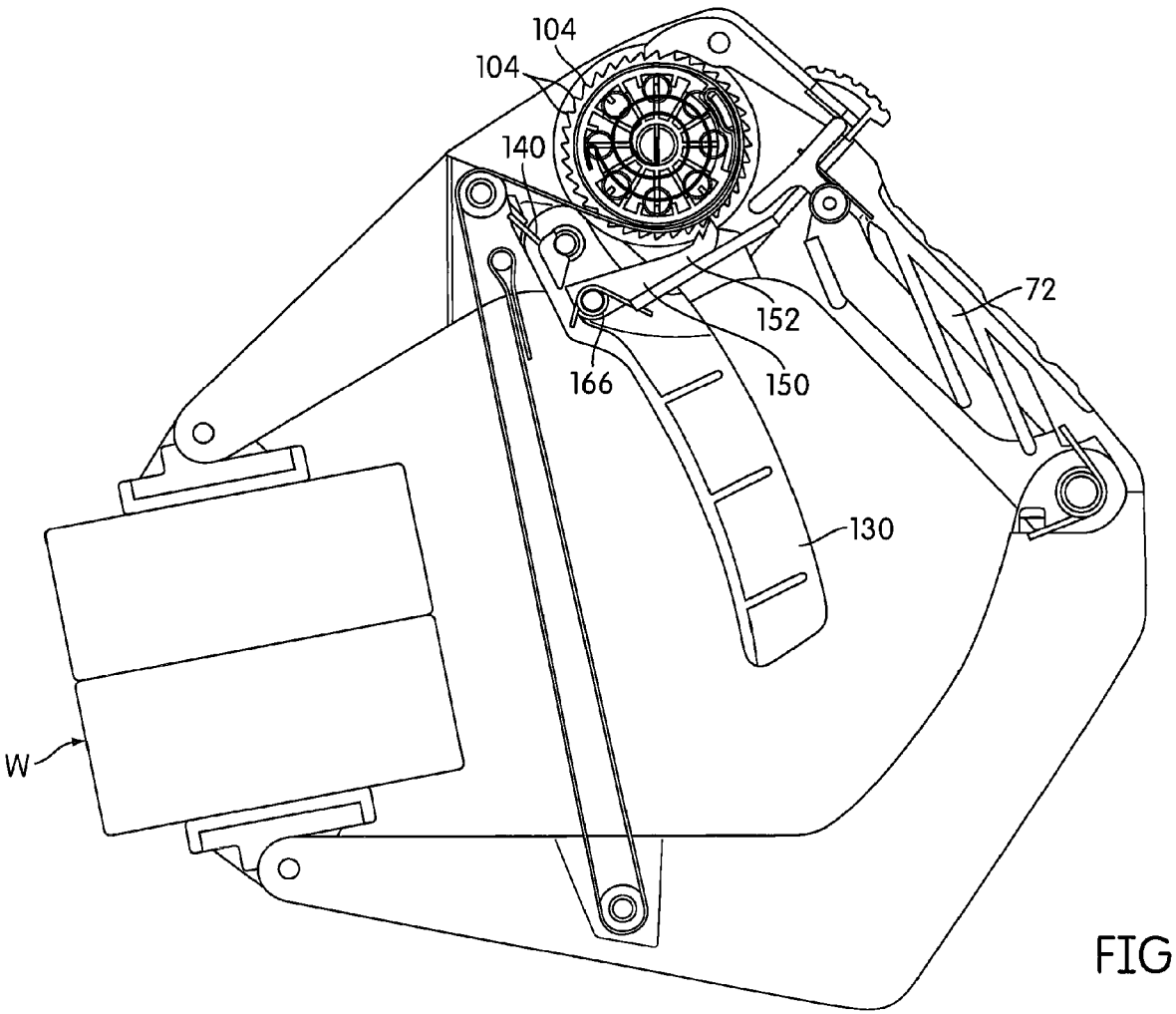

As shown in FIG. 9, a clamping force may then be applied to the workpiece W by squeezing of the lever 130. It should be appreciated that this action in FIG. 9, including the squeezing of the lever 130, can be commenced immediately, without resort to the quick close operation discussed above with respect to FIGS. 7 and 8. In other words, the user may commence the levering action after the clamp 10 achieves the position in FIG. 6 to more slowly clamp down onto a workpiece W, in the event that there is not a lot of distance between the clamp surfaces 68 and the workpiece (or bench for example) between the clamp surfaces 68. When the lever 130 is squeezed or brought closer to the hand grip portion 72, the drive members 152 are moved into engagement with the gear teeth 104 of the spool 80 (e.g., see FIGS. 13B and 13C). The drive pawl spring 166 places a tension onto to drive pawl 150 to maintain the teeth 154 of the drive member 152 in engagement with the teeth 104 of the spool 80. The lever 130 is biased in a clockwise direction by the lever spring 140, and the bias of the lever spring 140 is overcome by the user squeezing the lever 130 towards the hand grip portion 72 during the clamping action.

Figure 10:
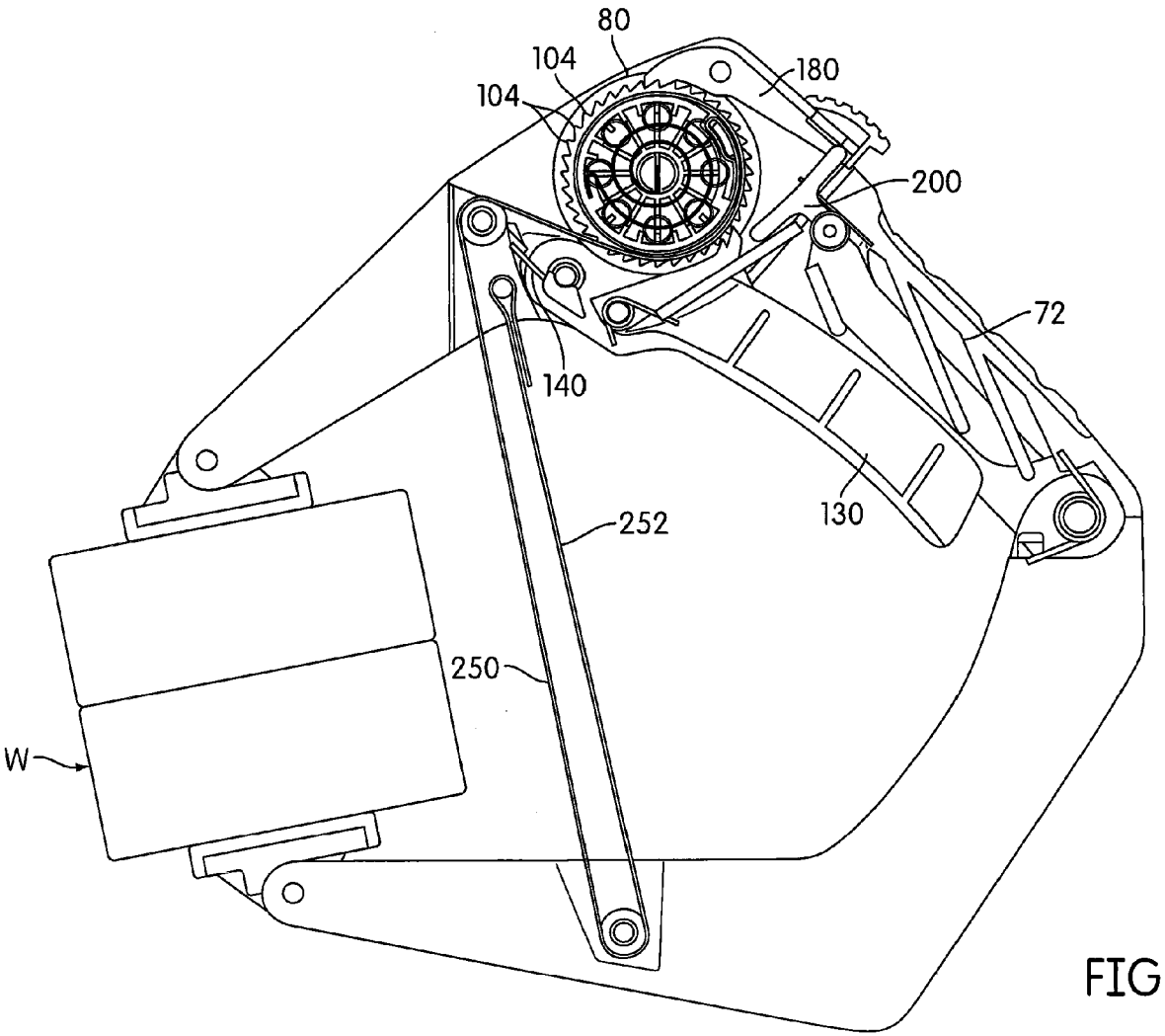

As shown in FIG. 10, the lever 130 has been moved towards the hand grip portion 72, and during this action, the spool 80 has been wound in a counterclockwise direction to take up additional portions of the flexible member 252 to apply a substantial clamping force on the workpiece W between the pivoted structures 74 and 54. As the spool 80 rotates, the flexible member 252 is wound on the spool, which pulls the bottom jaw 14 towards the top jaw 12 via the top pulley 232 and the bottom pulley 46. Double path of the flexible member 252 (i.e., from the top jaw 12, to the bottom jaw 14, back to the top jaw 12) multiplies the hand force from the user to provide a high clamping force. As the spool 80 rotates, the releasable lock 180 ratchets against the gear wheel teeth 104. The bell crank member 200 provides torque against the releasable lock 180 to maintain the releasable lock 180 in engagement with the gear teeth 104 and prevent any clockwise movement (loosening) of the spool 80. This locks the clamp's tension and provides a clamping force on the workpiece W. Releasing the lever 130 allows the lever spring 140 to pivot the lever 130 away from the hand grip portion 72 and return it to its home position. When the lever 130 is moved into its home position, the action of the stop surface 300 on the drive members 152 and the stop surface 302 inside the lever 130 ensures that the teeth 154 are held out of engagement with the spool teeth 104 in advance of the next ratcheting pull by the lever 130 towards the hand grip portion 72 (e.g., see FIG. 13A).

Figure 11:
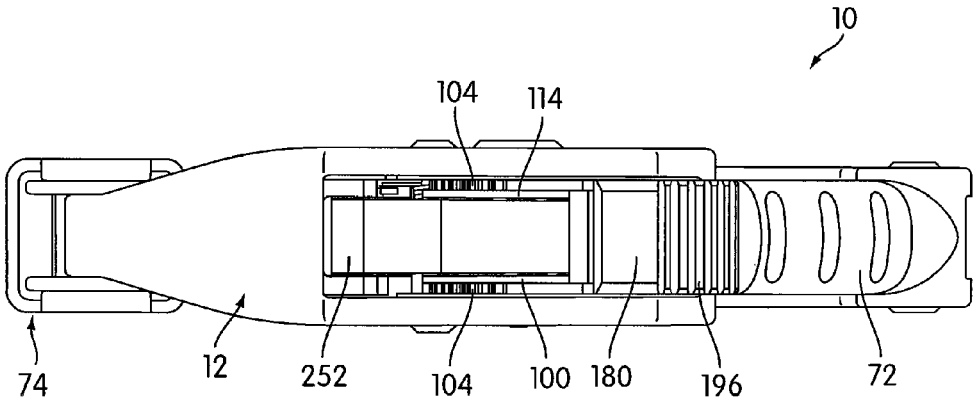
FIG. 11 shows a top elevational view of the clamp in accordance with an embodiment of the present invention.
Figure 12:
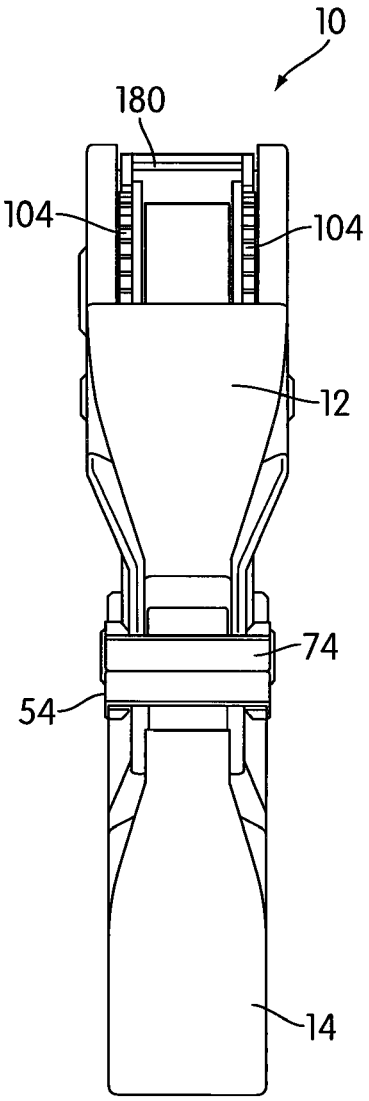
FIG. 12 shows a front elevational view of the clamp in accordance with an embodiment of the present invention.

FIG. 11 is a top elevational view, FIG. 12 is a front elevational view, and FIG. 13 is a rear side elevational view of the clamp 10 to illustrate various views of the clamp in accordance with one embodiment.

FIGS. 14-17 illustrate an alternative embodiment in accordance with various aspects of the present invention. This embodiment is similar to the embodiments previously described, except for the differences as will be noted below.

Figure 14:
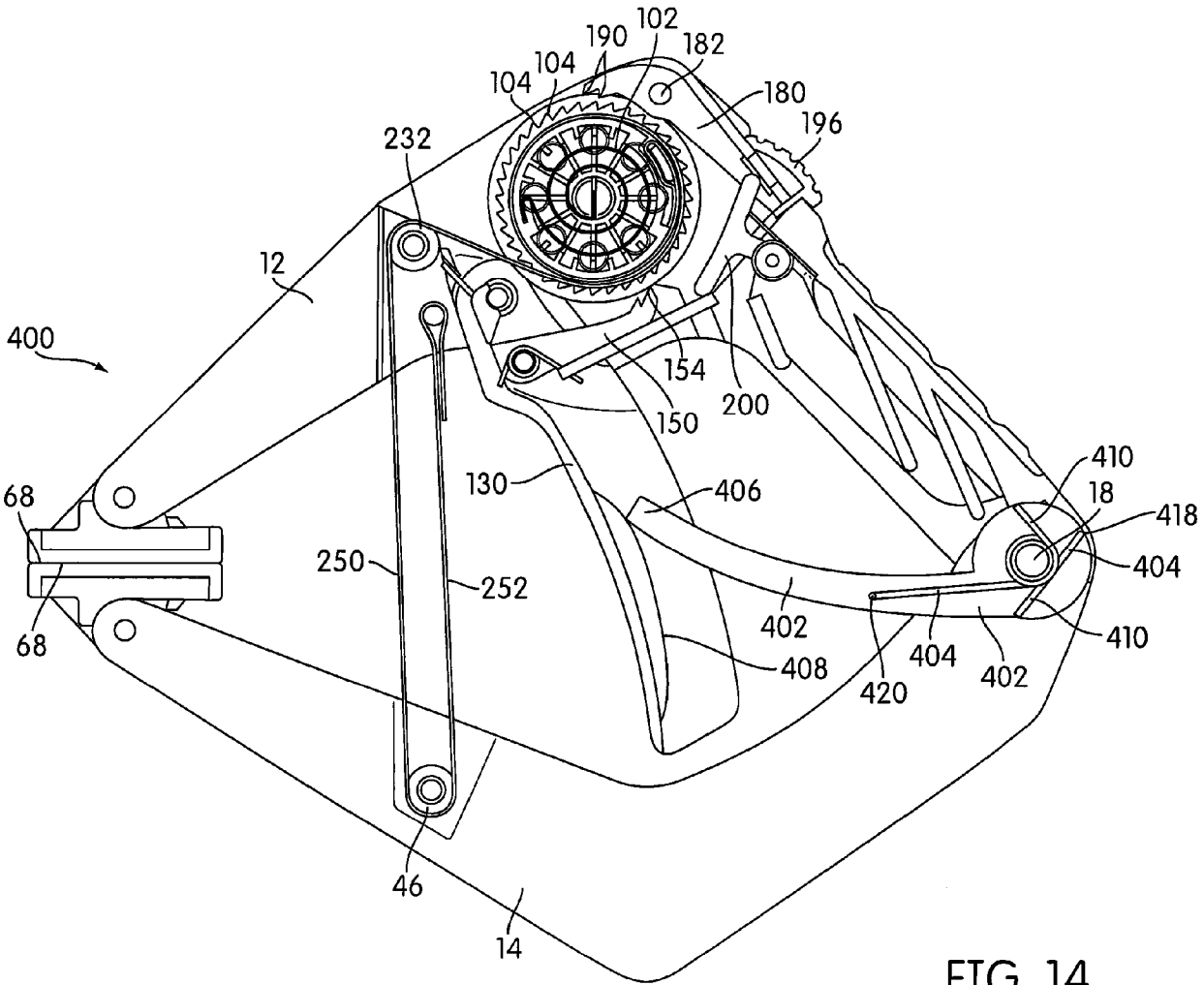
FIG. 14 shows a side view of the clamp in accordance with another embodiment of the present invention.
Figure 14A:
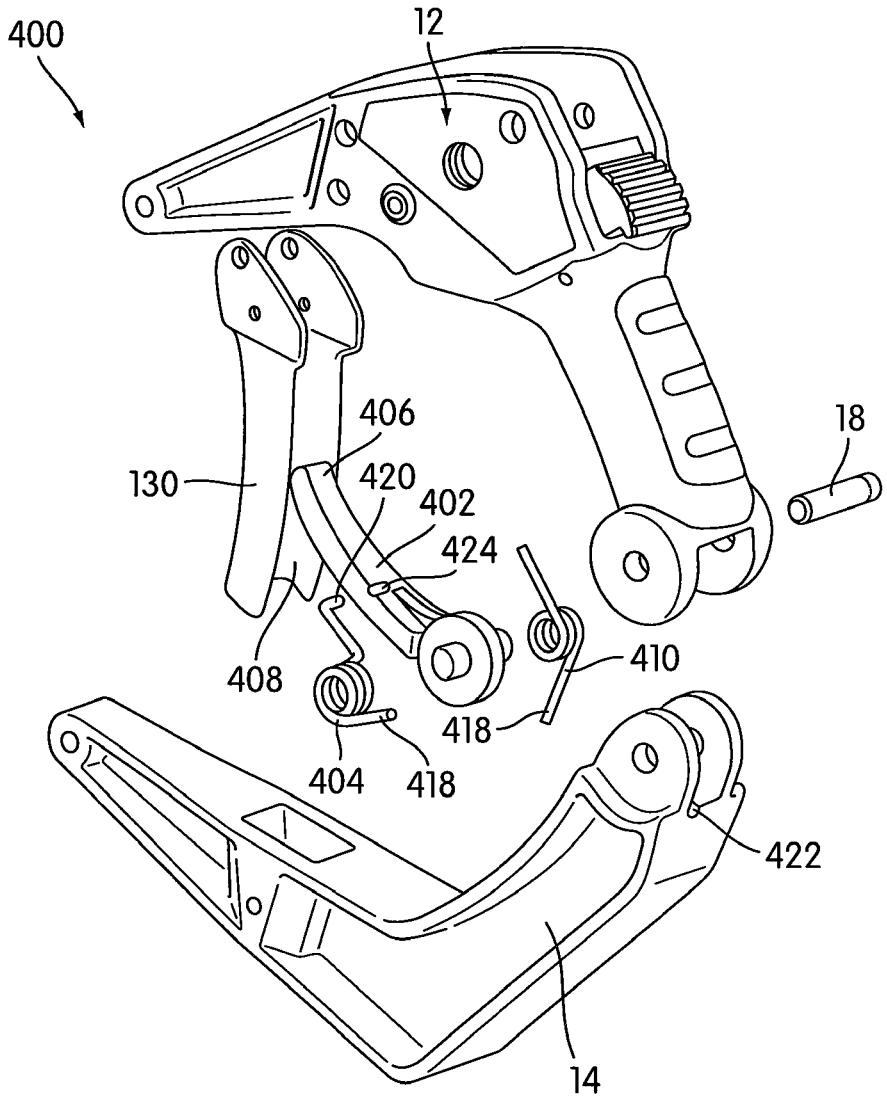
FIG. 14A shows an exploded view of various components of the clamp (in which various portions thereof have been removed to better reveal others) in accordance with an embodiment of the present invention.

In FIGS. 14 and 14A, a clamp 400 is shown that includes a bottom jaw arm 402, a bottom jaw arm spring 404, and a jaw pivot spring 410. The bottom jaw arm 402 is pivotally mounted for rotation about the pivot bolt 18, and the bottom jaw arm spring 404 biases the bottom jaw arm 402 in a counter clockwise direction. In one embodiment, one end 418 of the bottom jaw arm spring 404 is connected to the bottom jaw 14 and other end 420 of the bottom jaw arm spring 404 is connected to the bottom jaw arm 402 so as to bias the bottom jaw arm 402 towards the bottom jaw 14. In the illustrated embodiment, as shown in FIG. 14A, the end 418 of the bottom jaw arm spring 404 is received in a groove, a notch or an opening 422 in the bottom jaw 14, and the other end 420 of the bottom jaw arm spring 404 is received in a groove, a notch or an opening 424 in the bottom jaw arm 402.

A distal end portion 406 of the bottom jaw arm 402 engages with an interior surface 408 of the lever 130 so as to tend to bias the lever 130 in a clockwise direction. In this embodiment, and optionally in the previous embodiment, stop surface between the lever 130 and the first jaw 12 prevent further clockwise movement of the lever 130 beyond the position shown. In one embodiment, the interior surface 408 of the lever 130 engages with distal end portion 406 of the bottom jaw arm 402 to prevent any further counter clockwise movement of the bottom jaw arm 402 beyond the position shown in FIG. 14. Thus, the interior surface 408 acts as a stop surface.

In one embodiment, the jaw pivot spring 410 is pivotally mounted for rotation about the pivot bolt 18. In one embodiment, the jaw pivot spring 410 biases (or separates) the first and the second jaws 12 and 14 apart. In one embodiment, one end of the jaw pivot spring 410 is connected to the first jaw 12 and the other end is connected to the second jaw 14.

In one embodiment, the bottom jaw arm spring 404 is constructed and arranged to exert a force to bias the second jaw 14 towards the bottom jaw arm 402. However, a force exerted by the jaw pivot spring 410 to bias the first jaw 12 and the second jaw 14 apart is greater than the force exerted by the bottom jaw arm spring 404. Therefore, when the jaws 12 and 14 are fully open (See FIG. 14B), the force exerted by the jaw pivot spring 410 prevents the movement of the second jaw 14 towards the bottom jaw arm 402 (i.e., under the force of the spring 404). In another embodiment, the spring 404 is at rest (equilibrium) when the lever 130 is not squeezed (at home position) and only stressed when the lever 130 is squeezed.

Figure 14B:
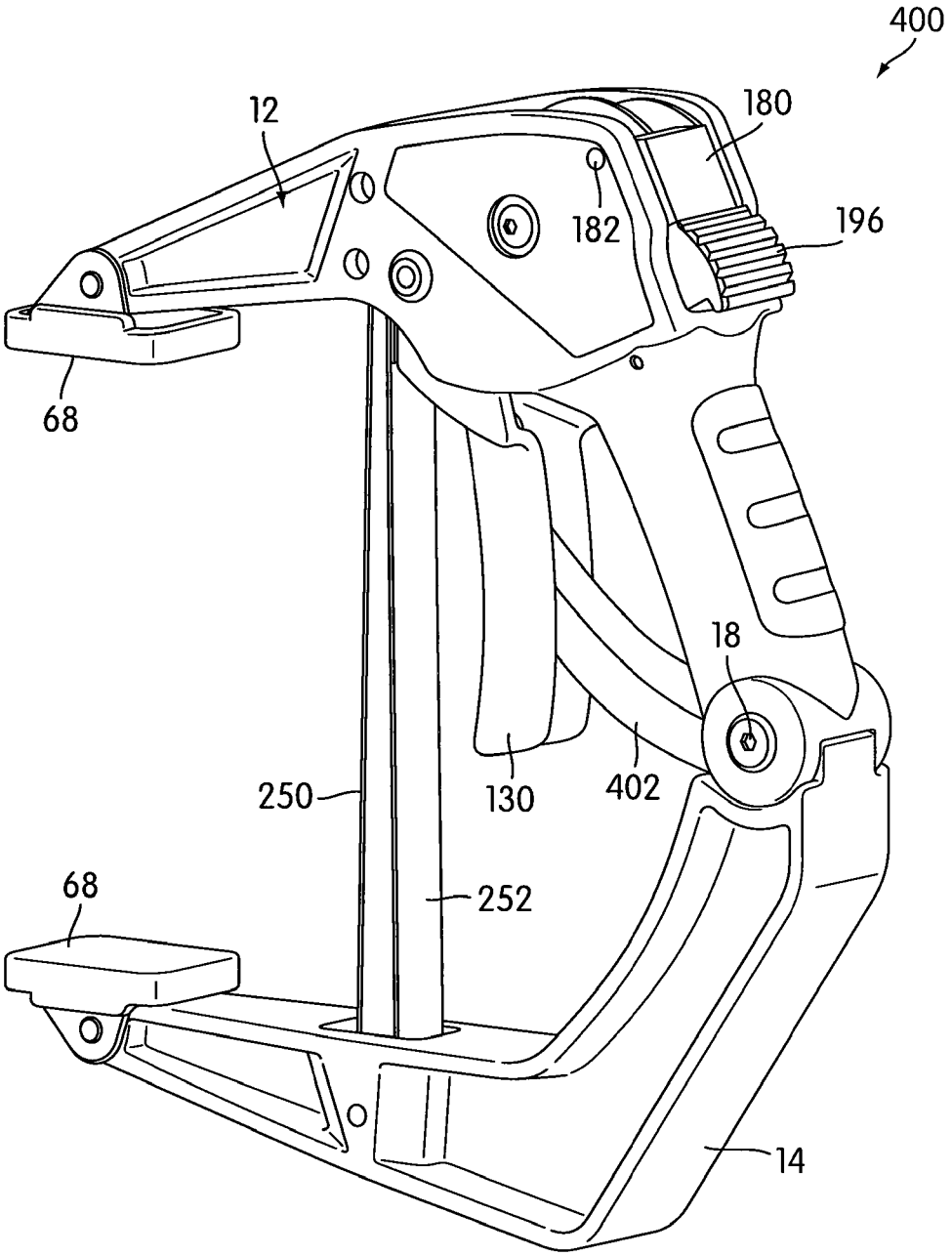
FIG. 14B shows an isometric view of the clamp in a fully open position in accordance with an embodiment of the present invention.
Figure 14C:
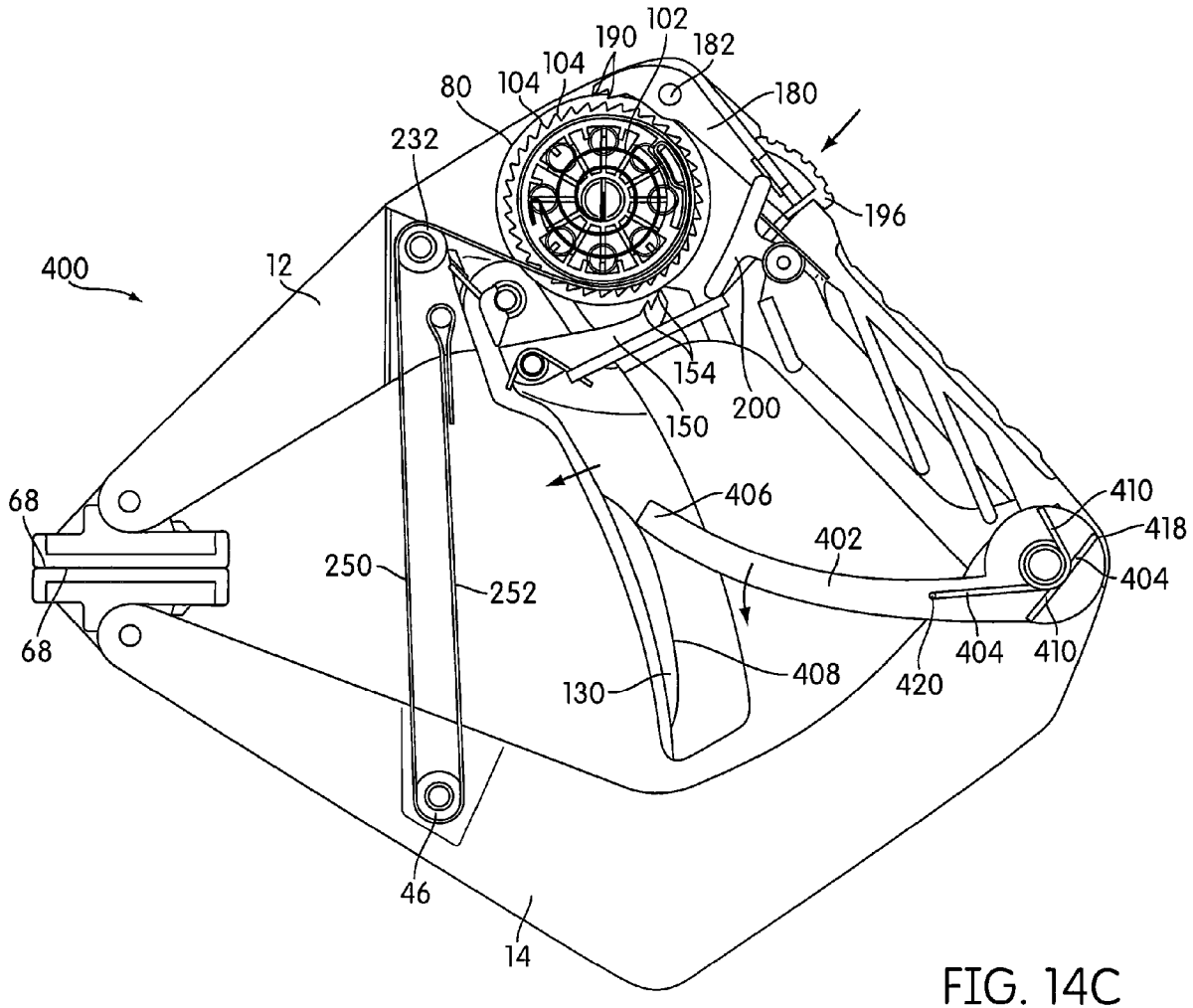
FIG. 14C shows a side view of the clamp (in which various portions thereof have been removed to better reveal others), wherein jaws of the clamp are in a closed configuration in accordance with an embodiment of the present invention.

In one embodiment, as shown in FIGS. 14B and 14C, to move the clamp 400 to a fully open position, the manually engageable portion 196 of the releasable lock 180 is depressed by the user. As a result of this action, the releasable lock 180 has been pivoted in a clockwise direction about the lock pin 182 so that the lock teeth 190 are brought out of engagement with the gear teeth 104. Once the lock teeth 190 are brought out of engagement with the gear teeth 104, the jaw pivot spring 410 biases (or separates) the first and the second jaws 12 and 14 apart. As shown in FIG. 14C, the drive pawl 150 is already in the disengaged position when the lever 130 is in the home position (as shown). In one embodiment, the lever 130 is biased into this home position by the force of the bottom jaw arm 402, which is biased by the bottom jaw arm spring 404, and the pawl 150 is disengaged as a result of the lever 130 being held in such position. In another embodiment, the pawl 150 is moved to the disengaged position by the action of the bell crank member 200 when the manually engageable portion 196 of the releasable lock 180 is depressed.

In one embodiment, the force exerted by the jaw pivot spring 410 is greater than a force exerted by the spool spring 102. As a result, during this jaw opening operation, the jaws 12 and 14 are moved apart (separated), and the second connection 250 is elongated to permit such separation. For example, in an embodiment, where the second connection 250 is a flexible member, the flexible member 252 is pulled by the pulley 46 acting thereon so as to be un-wound about the spool 80, which is rotated in a clockwise direction against the bias of the spiral spring 102 under the force of jaw separation exerted by the jaw pivot spring 410. During this action, the lower pulley 46 is rotated in a counterclockwise direction, and the upper pulley 232 is also rotated in a counterclockwise direction to accommodate elongation of the second connection 250. Also, as noted above, as the force exerted (to bias the first jaw 12 and the second jaw 14 apart) by the jaw pivot spring 410 is greater than any force that may be exerted (to bias the second jaw 14 towards the bottom jaw arm 402) by the bottom jaw arm spring 404, this greater force of the jaw pivot spring 410 prevents the biasing of the second jaw 14 towards the bottom jaw arm 402.

Figure 15:
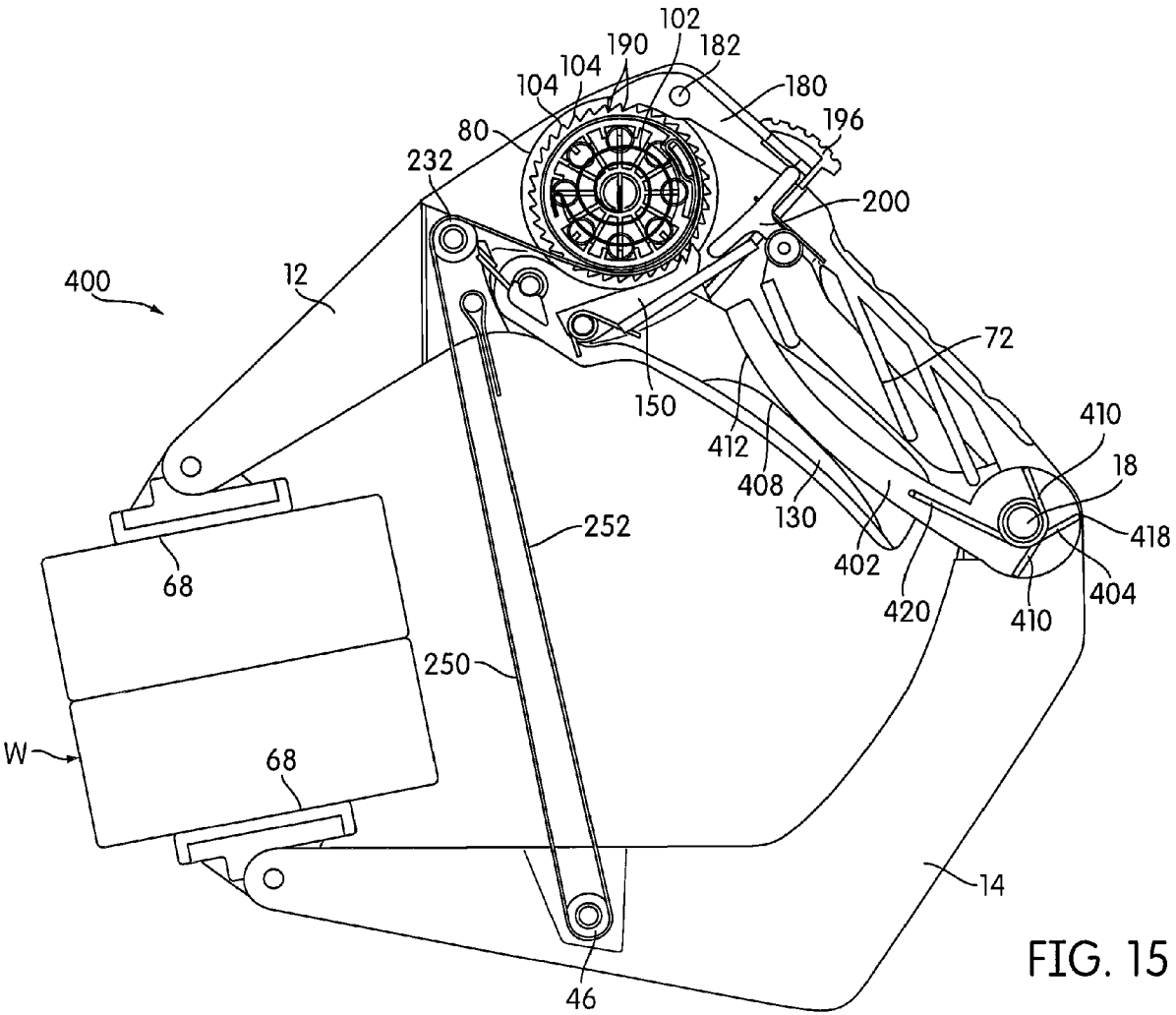
FIGS. 15-17 shows a clamp "quick close" operation in which opposing clamp surfaces are quickly brought into contact with opposite sides of the workpiece in accordance with an embodiment of the present invention.

FIG. 15 illustrates an initial "clamp quick close" condition in which the opposing clamp surfaces 68 are quickly brought into contact with opposite sides of the workpiece. In contrast with the previous embodiment, wherein the free wheeling of the spool 80 under the force of the spiral spring 102 facilities such action, in this embodiment, the manually engageable portion 196 need not be depressed, and the drive pawl 150 can remain in engagement with the gear teeth 104. Instead, as the drive lever 130 is squeezed, a forward surface 412, having a convex shape, slidably engages along the convex interior surface 408 of the drive lever 130. This action forcibly pivots the bottom jaw arm 402 to be pivoted about the pivot bolt 18 in a clockwise direction, against the bias of the bottom jaw arm spring 404, so that the bottom jaw arm 402 is essentially along side the hand grip portion 72. As a result of this action, the force of the bottom jaw arm spring 404 acts upon the bottom jaw 14 so as to move the bottom jaw 14 towards the top jaw 12.

Figure 16:
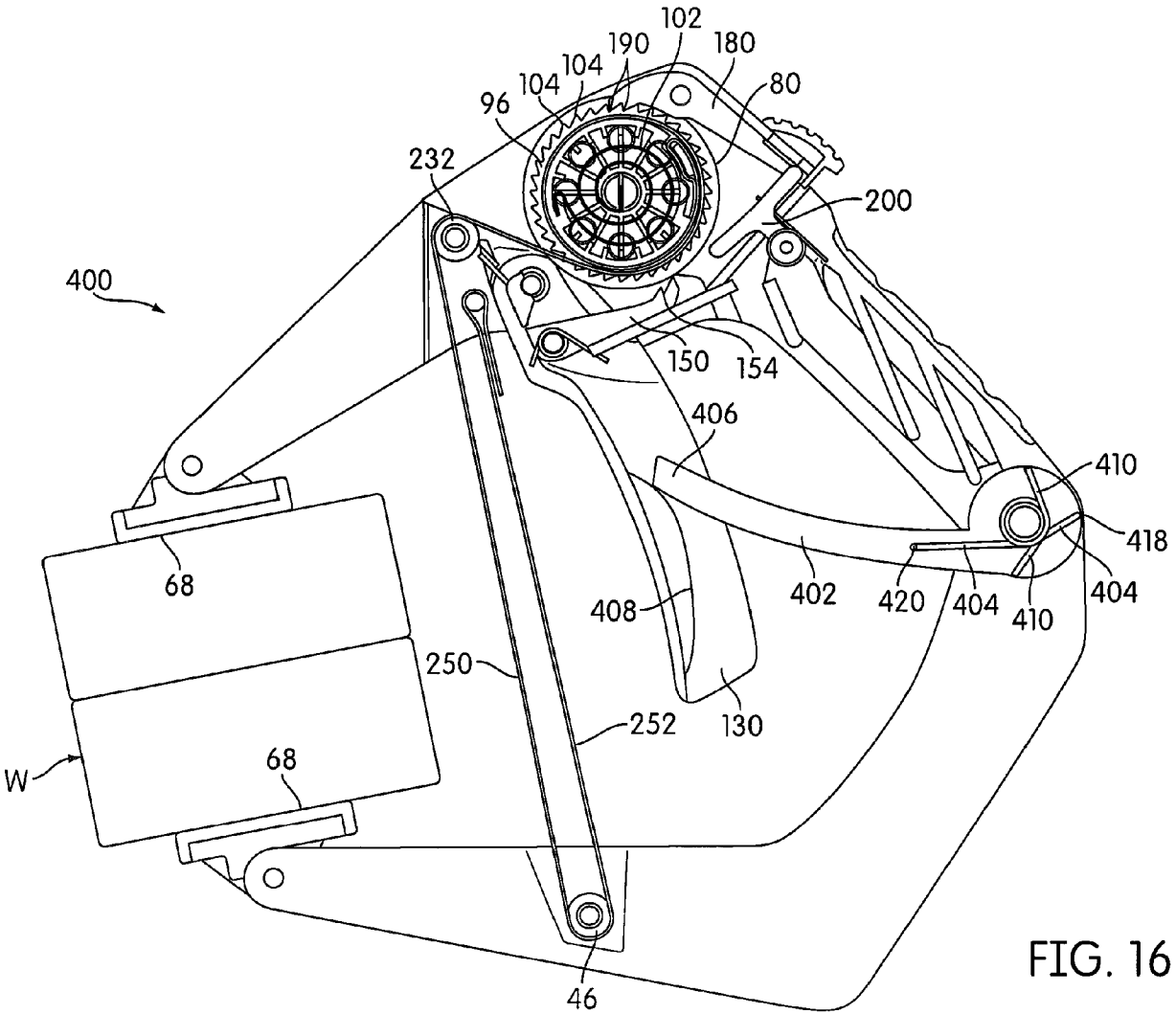

As shown in FIG. 16, when the pressure is released from the lever 130, the bottom jaw arm 402 and the bottom jaw arm spring 404 pushes the lever 130 in a clockwise direction towards its initial "home" position. During this action, the drive pawl 150 is disengaged from the gear teeth 104 of the gear wheel 96. As a result, the spiral spring 102 rapidly rotates the spool 80 in a counter clockwise direction so as to remove any slack in the flexible member (e.g., strap) 252. The releasable lock 180 has its teeth 190 thereof remain in engagement with the gear wheel teeth 104 so as to convent clockwise rotation of the spool 80 so as to hold "ratchet" jaws into position.

Figure 17:
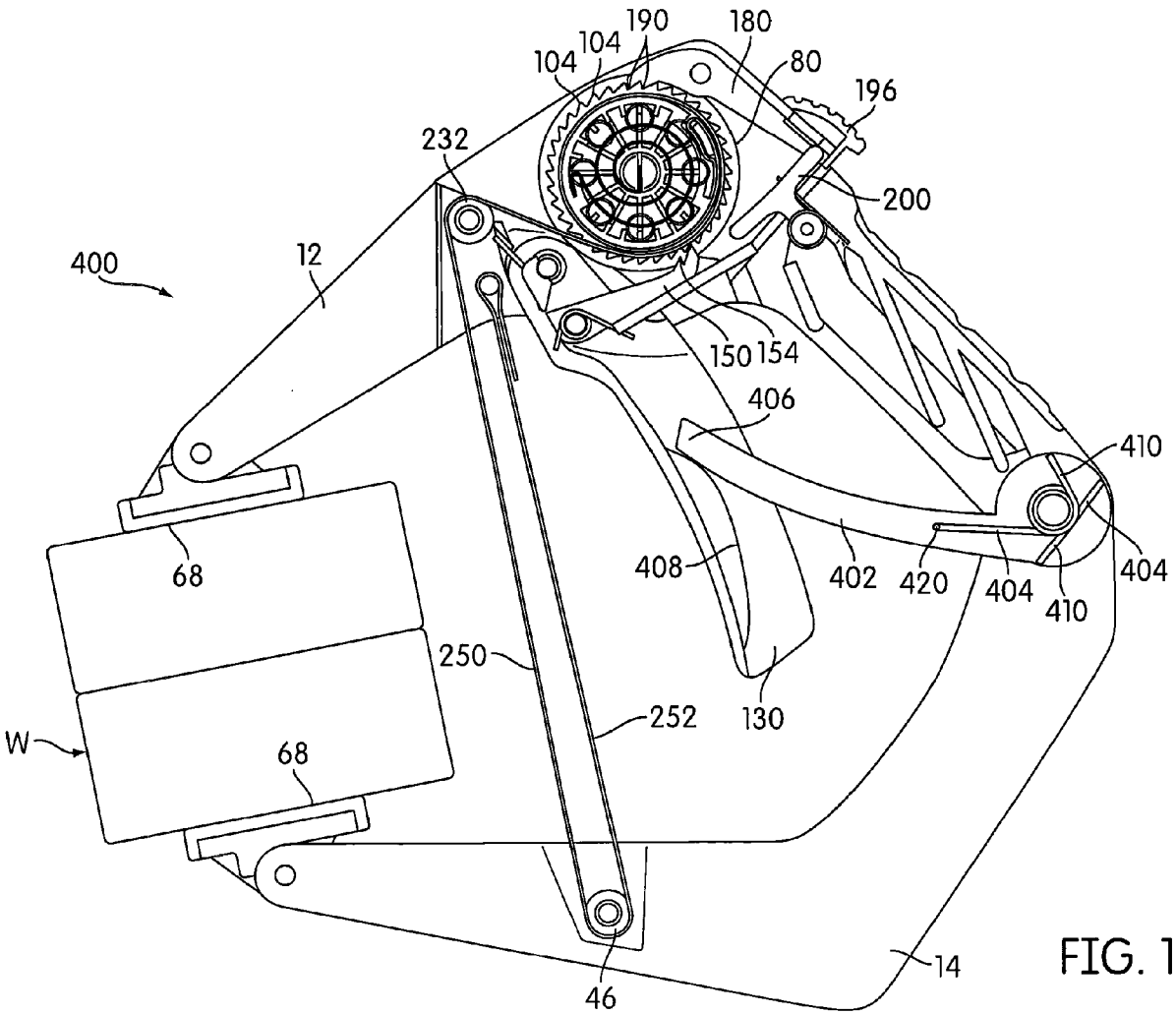

As shown in FIG. 17, the "quick close" operation has finished, and further clamp tensioning is accomplished by squeezing of the lever 130, which first brings drive pawl teeth 154 into engagement with the gear teeth 104, and continued squeezing of lever 130 causes the spool 80 to rotate in a counter clockwise direction to pull on the flexible member 252 so as to squeeze the workpiece between the two jaws. During this action, the teeth 190 of the releasable lock 180 skip over the gear teeth 104 in a ratcheting action. At the end of a first squeezing step, the lever 130 can be released, the bottom jaw arm 402 and the bottom jaw arm spring 404 pushes the lever 130 back to the home position as the teeth 154 of the pawl 150 ride over the gear wheel teeth 104 to begin the next ratchet cycle.

In another embodiment (not shown in the FIGS), the second connection 250 may be in form of a rigid member, such as a bar, or a threaded rod that can be acted upon by an actuator in the form of a pinion (as in a rack and pinion arrangement), a gear train, or a lever. Such pinion or lever may be operated by a lever (similar in function to the lever 130) operatively connected thereto (e.g., by teeth, frictional arrangement, or ratcheting pawl arrangement, for example). Alternatively, such second connection, whether rigid or flexible may be shortened or lengthened by an electrical or a hydraulic actuator, rather than a manual one. For example, the actuator may comprise an electric (AC or DC) motor that is operatively connected to the rigid or flexible second connection to lengthen or shorten the second connection. The motor may be button or switch activated. In one embodiment, the flexible member 252 can be formed of a strong cloth material, such as a nylon fabric, although other materials may also be used, such as an elastomer material, or other flexible materials. In another embodiment, the flexible member 252 can be formed of a metallic or a non-metallic cable.

It is further contemplated that although the spool 80 and the lever arrangement 130 is used as the actuator in embodiment disclosed herein, other actuators may also be used to shorten the length of the second connection 250 during the clamping process. The actuator may take many different forms that can operate on the second connection to reduce the length thereof. In addition, although the first connection 16 in a disclosed embodiment is a pivoted connection, other types of connections (e.g., a linear connection, an arcuate connection, for example, may be provided). In addition, although the first connection 16 in the illustrated embodiment is a direct connection between the first jaw 12 and second jaw 14, it is contemplated that various other components may be positioned between the jaws 12 and 14 to connect the jaws 12 and 14 to one another.

As noted earlier, the actuator 79 may be a hand powered actuator, an electric powered actuator, or a hydraulic actuator, as would be appreciated by one of ordinary skill in the art reading this specification.

As noted earlier, in one embodiment, the actuator 79 may include the spool 80 operatively connected to the lever 130. In an alternative embodiment, however, the actuator 79 may include only the spool without the lever. In such an embodiment, the spool may cooperate with a one-way pawl, and the second connection itself (e.g., such as the strap) may be manually pulled directly to effect shortening of the second connection and closing of the clamp. In one embodiment, the actuator can be any one-way pawl that can ratchet or move the second connection to reduce a length thereof. In one embodiment, instead of a spool with gear teeth, the actuator may take the form of a friction wedge, lever, or a cam that is constructed and arranged to frictionally wedge or cam the second connection directly or indirectly to shorten and/or lengthen the second connection. In one embodiment, a manual (hand) force may be applied to wind up the additional portions of the flexible member 252. Alternatively, a small spool operated by a crank may be used (instead of the manual force) to wind up the additional portions of the flexible member 252.

In one embodiment, the jaws 12 and 14 are formed from a tough plastic material, although metal, wood, or other appropriate material may be used. In addition, while the gear wheel 96, the spool cover 100, and the spool cup 98 may be formed from a plastic material, a metal material is also contemplated. In addition, while the spiral spring 102 used in one embodiment formed from a spring steel material, other materials, such as composite materials, may also be used. The pins described herein may in one embodiment be formed from a metal material, but may also be formed from a tough plastic material or a composite material as well. The clamp surfaces 68 may be formed from a resilient or elastomeric or rubber material, although plastic materials can also be used.

In the illustrated embodiment, the flexible member 252 (or cloth strap 252) may be considered to have a rearward portion 310 (which is closer to the handgrip portion 72) and a forward portion 312 (which is closer to the clamp surfaces 68). In the illustrated embodiment, the forward portion 312 may be subject to some what a greater amount of movement relative to the rearward portion 310. Thus, it is contemplated that the orientations of the different portions 310 and 312 may be switched so that the lesser moving portion would be closer to the workpiece to be clamped by the clamp surfaces 68 to thereby reduce potential abrasion of the flexible member 252 against the workpiece during ratcheting or opening of the jaws 12 and 14. For example, the top pulley 232 may be moved slightly closer to the spool 80, and the anchor portion 238 slightly closer to the distal end 76 of the first jaw 12, while the forward portion 312 and the rearward portion 310 would be oppositely looped around the lower pulley 46. In another embodiment, the flexible member 252 may not be trained about the first and the second pulleys, instead the flexible member 252 may be constructed and arranged to make a single pass between the first and the second jaw 12 and 14.

In one embodiment, the clamp may be used by positioning jaws 12 and 14 on opposite sides of the workpiece W to be clamped. The workpiece W is any member or members that needs clamping. For example, in one embodiment, the workpiece W may be two elements that are being joined together by adhesive and require a clamping force to ensure a tight connection while the adhesive cures.

In one embodiment, the clamp surfaces 68 on the jaws 12, 14 may be planar. In another embodiment, the clamp surfaces 68 on the jaws 12, 14 may be angled or curved. In one embodiment, the clamp surfaces 68 on the jaws 12, 14 may include a surface texture or a pattern (e.g., ribbed) that is constructed and arranged to improve the grip of the workpiece W to be clamped.

In one embodiment, the jaws 12, 14 may have advertising or promotional information such as indicia (not shown) for identifying the product and/or manufacturer to the customers.

In one embodiment, the hand grip portion 72 of the jaw 12 is simply the outer surface of the jaw 12. In one embodiment, the hand grip portion 72 of the jaw 12 is made of an elastomeric material, a rubber based material, a plastic based material or other suitable material. Optionally, the hand grip portion 72 can be ergonomically shaped. In one embodiment, a surface texture or pattern (e.g., ribbed) may be provided on the hand grip portion 72. The surface texture or pattern is constructed and arranged to improve the grip of the user. The surface texture or pattern may be provided by knurling, sand blasting, rubber coating, or any other surface texturing methods known in the art. In one embodiment, the hand grip portion 72 may include a slip-resistant surface that is constructed and arranged to be used in all weather conditions. In one embodiment, the hand grip portion 72 may include a cushioned grip.

Although the invention has been described in detail for the purpose of illustration, it is to be understood that such detail is solely for that purpose and that the invention is not limited to the disclosed embodiments, but, on the contrary, is intended to cover modifications and equivalent arrangements that are within the spirit and scope of the appended claims. In addition, it is to be understood that the present invention contemplates that, to the extent possible, one or more features of any embodiment can be combined with one or more features of any other embodiment.

What is claimed is:

1. A clamp, comprising:

a first jaw including a first clamp surface;

a second jaw including a second clamp surface;

a first connection that operatively connects the first jaw to the second jaw in a manner that permits relative movement between the first jaw and the second jaw;

a second connection operatively connected between the first jaw and the second jaw, the second connection comprising a flexible member; and an actuator operably connected with the flexible member, the actuator being configured to pull the flexible member and thereby shorten a length of the flexible member, wherein the pulling of the flexible member reduces a relative distance between the first clamp surface and the second clamp surface.

2. The clamp according to claim 1, wherein the first connection comprises a pivotal connection between the first jaw and the second jaw.

3. A clamp, comprising:

a first jaw including a first clamp surface;

a second jaw including a second clamp surface;

a first connection that operatively connects the first jaw to the second jaw in a manner that permits relative movement between the first jaw and the second jaw;

a second connection operatively connected between the first jaw and the second jaw, the second connection comprising a flexible member; and an actuator operably connected with the flexible member, the actuator being configured to shorten a length of the second connection to thereby reduce a relative distance between the first clamp surface and the second clamp surface, wherein the flexible member comprises a strap.

4. The clamp according to claim 3, wherein the strap is formed from a nylon material.

5. A clamp, comprising:

a first jaw including a first clamp surface;

a second jaw including a second clamp surface;

a first connection that operatively connects the first jaw to the second jaw in a manner that permits relative movement between the first jaw and the second jaw;

a second connection operatively connected between the first jaw and the second jaw, the second connection comprising a flexible member; and an actuator operably connected with the flexible member, the actuator being configured to shorten a length of the second connection to thereby reduce a relative distance between the first clamp surface and the second clamp surface, wherein the actuator comprises a spool onto which the flexible member is wound.

6. The clamp according to claim 5, wherein the actuator comprises a lever arranged to rotate the spool to wind the flexible member onto the spool.

7. The clamp according to claim 6, wherein gear teeth are arranged on the spool to enable the lever to rotate the spool.

8. The clamp according to claim 7, wherein the lever comprises a drive pawl arranged to engage the gear teeth.

9. The clamp according to claim 8, further comprising a spool spring arranged to bias the spool in a direction to wind up the flexible member.

10. The clamp according to claim 5, further comprising a spool spring arranged to bias the spool in a direction to wind-up the flexible member.

11. The clamp according to claim 10, wherein the spool spring is arranged to rotate the spool to wind-up the flexible member so that the first and second clamp surfaces are movable under the force of the spool spring to engage a workpiece therebetween.

12. The clamp according to claim 11, wherein the actuator is arranged to forcibly rotate the spool, after the spool spring moves the clamp surfaces into engagement with the workpiece, so as to apply an increased clamp force to the workpiece.

13. The clamp according to claim 9, further comprising a lock pawl arranged to be locked to prevent the spool from being rotated to wind up the flexible member.

14. The clamp according to claim 13, further comprising a release member, the release member being actuatable to release the lock pawl to enable the spool to wind up the flexible member.

15. A clamp, comprising:

a first jaw including a first clamp surface;

a second jaw including a second clamp surface;

the first jaw being arranged for pivotal movement relative to the second jaw;

a flexible member extending between the first jaw and the second jaw;

a spool rotatable to take up the flexible member to reduce a distance between the first and the second clamp surfaces; and a lever operable to rotate the spool.

16. The clamp according to claim 15, further comprising a spool spring arranged to bias the spool in a direction to take up the flexible member.

17. The clamp according to claim 16, wherein the flexible member is a fabric strap.

18. The clamp according to claim 15, wherein the first and the second clamp surfaces are formed on pivotable structures.

19. The clamp according to claim 15, wherein the first and the second jaws are directly pivotally connected to one another.

20. The clamp according to claim 15, further comprising a first pulley on the first jaw and a second pulley on the second jaw, wherein the flexible member is trained about the first and the second pulleys.

21. A clamp, comprising:

a first jaw including a first clamp surface;

a second jaw including a second clamp surface;

a first connection that operatively connects the first jaw to the second jaw in a manner that permits relative movement between the first jaw and the second jaw;

a second connection spaced from the first connection and operatively connected between the first jaw and the second jaw; and an actuator operably connected with the second connection, the actuator pulling the second connection to thus shorten a length of the second connection to thereby drive the first clamp surface and the second clamp surface towards one another.

22. The clamp according to claim 21, wherein the second connection comprises a flexible member.

23. A clamp, comprising:

a first jaw including a first clamp surface;

a second jaw including a second clamp surface;

a first connection that operatively connects the first jaw to the second jaw in a manner that permits relative movement between the first jaw and the second jaw;

a second connection operatively connected between the first jaw and the second jaw; and an actuator operably connected with the second connection, the actuator being configured to shorten a length of the second connection to thereby reduce a relative distance between the first clamp surface and the second clamp surface, wherein the second connection comprises a flexible member and wherein the flexible member comprises a strap.

24. The clamp according to claim 23, wherein the actuator includes a spool on which the strap is wound.

25. The clamp according to claim 21, further comprising a jaw spring that biases the first and the second jaws apart.

26. The clamp according to claim 25, further comprising an actuator spring that biases the actuator to shorten the length of the second connection.

27. A clamp, comprising:

a first jaw including a first clamp surface;

a second jaw including a second clamp surface;

a first connection that operatively connects the first jaw to the second jaw in a manner that permits relative movement between the first jaw and the second jaw;

a second connection operatively connected between the first jaw and the second jaw;

an actuator operably connected with the second connection, the actuator being configured to shorten a length of the second connection to thereby reduce a relative distance between the first clamp surface and the second clamp surface;

a jaw spring that biases the first and the second jaws apart; and an actuator spring that biases the actuator to shorten the length of the second connection, wherein the jaw spring is stronger than the actuator spring.

28. The clamp according to claim 27, further comprising an actuator release which, when released, allows the jaw spring to separate the first and the second jaws so that the second connection is permitted to lengthen against the bias of the actuator spring.

29. The clamp according to claim 21, further comprising a spring biased arm, and wherein actuation of the actuator in an initial actuation causes the arm to move the first and second jaws towards one another to engage a workpiece that may be placed therebetween.

30. The clamp according to claim 29, wherein subsequent actuation of the actuator applies a ratcheting force onto the second connection to shorten the length thereof.

31. The clamp according to claim 21, wherein the first connection comprises a pivotal connection.

32. The clamp according to claim 31, wherein the pivotal connection is directly between the first and the second jaws.

* * * * *